US010729233B2

(12) United States Patent
Knudtson et al.

(10) Patent No.: US 10,729,233 B2
(45) Date of Patent: Aug. 4, 2020

(54) LENGTH ADJUSTABLE SUPPORT AND COMPONENTS OF SAME

(71) Applicant: OMT-VEYHL USA CORPORATION, Holland, MI (US)

(72) Inventors: Matthew Knudtson, Holland, MI (US); Scott Boboltz, Holland, MI (US); Dan Lerz, Holland, MI (US)

(73) Assignee: OMT-VEYHL USA CORPORATION, Holland, MI (US)

( * ) Notice: Subject to any disclaimer, the term of this patent is extended or adjusted under 35 U.S.C. 154(b) by 0 days.

(21) Appl. No.: 16/418,161

(22) Filed: May 21, 2019

(65) Prior Publication Data

US 2019/0357668 A1 Nov. 28, 2019

Related U.S. Application Data

(60) Provisional application No. 62/676,125, filed on May 24, 2018.

(51) Int. Cl.

| | |
|---|---|
| ***A47B 9/04*** | (2006.01) |
| ***A47B 9/20*** | (2006.01) |
| ***A47C 3/40*** | (2006.01) |

(52) U.S. Cl.

CPC ..... *A47B 9/04* (2013.01); *A47B 9/20* (2013.01); *A47C 3/40* (2013.01); *A47B 2200/0059* (2013.01)

(58) Field of Classification Search

CPC .... A47B 9/00; A47B 9/04; A47B 9/20; A47B 2200/0051; A47C 3/40

USPC ..... 108/147, 144.11, 147.19; 248/188.2, 248/188.5

See application file for complete search history.

(56) References Cited

U.S. PATENT DOCUMENTS

| | | | | |
|---|---|---|---|---|
| 3,963,288 | A * | 6/1976 | Burnett | A47B 9/04 312/209 |
| 6,478,269 | B2 * | 11/2002 | Forsberg | A47B 9/00 108/147.19 |
| 6,494,005 | B2 * | 12/2002 | Zimmerman | B66F 3/10 108/147 |
| 10,512,334 | B1 * | 12/2019 | Koh | A47C 3/30 |
| 10,595,629 | B2 * | 3/2020 | Ko | A47B 9/20 |
| 2002/0043597 | A1 * | 4/2002 | Forsberg | A47B 9/04 248/188.8 |
| 2006/0279143 | A1 * | 12/2006 | Platz | A47B 9/04 310/51 |

(Continued)

*Primary Examiner* — Jose V Chen

(74) *Attorney, Agent, or Firm* — Barnes & Thornburg LLP

(57) ABSTRACT

A length-adjustable support having a telescopic column assembly that includes a rotatable spindle rod configured to telescope an interior tube into and out of an exterior tube, or vice versa, of the telescopic column assembly in order to adjust the length of the length-adjustable support. The column assembly is illustratively attached to a motor housing containing a motor that rotates the spindle rod. In illustrative embodiments, a portion of the spindle rod is attached to the motor housing via a bushing member comprising two complimentary bushing components that surround the spindle rod and support a spindle plate that mates with the spindle rod to rotate therewith. The motor assembly is configured to substantially float within the motor housing and is attached to a flange of the housing by a clip or grommet that retains an attachment arm of the motor assembly.

20 Claims, 19 Drawing Sheets

(56) References Cited

U.S. PATENT DOCUMENTS

| | | | | |
|---|---|---|---|---|
| 2009/0121100 | A1* | 5/2009 | Waidelich | A47B 9/04 248/188.4 |
| 2013/0093231 | A1* | 4/2013 | Hsu | B62J 1/08 297/344.19 |
| 2017/0051869 | A1* | 2/2017 | Hsiao | F16M 11/26 |
| 2017/0135466 | A1* | 5/2017 | Randlov | A47B 9/04 |
| 2017/0224101 | A1* | 8/2017 | Bruder | A47B 9/04 |
| 2017/0238697 | A1* | 8/2017 | Randlov | A47B 9/20 |
| 2017/0303679 | A1* | 10/2017 | Tseng | A47B 9/04 |
| 2018/0092457 | A1* | 4/2018 | Lai | A47B 9/12 |
| 2018/0172062 | A1* | 6/2018 | Hu | H02K 7/06 |
| 2018/0184799 | A1* | 7/2018 | Lin | A47B 17/02 |
| 2019/0254418 | A1* | 8/2019 | Ryholl | A47B 9/04 |
| 2020/0085184 | A1* | 3/2020 | Lu | A47B 9/20 |

* cited by examiner

DETAIL C

DETAIL D

DETAIL E

LENGTH ADJUSTABLE SUPPORT AND COMPONENTS OF SAME

CROSS REFERENCE TO RELATED APPLICATIONS

This application claims the benefit of priority under 35 U.S.C. § 119(e) to U.S. Provisional Patent Application No. 62/676,125, filed May 24, 2018. The disclosure set forth in the referenced application is incorporated herein by reference in its entirety.

FIELD OF THE INVENTION

The present invention relates generally to a length adjustable support, in particular a height-adjustable support utilizing telescoping columns that includes a spindle and motor assembly.

BACKGROUND

This invention relates to a length-adjustable support with at least an outer tube and a telescoping inner tube. The support may further include a telescopic support column guided inside the tubes to adjust the length of the support.

Pieces of furniture such as tables or office chairs that include legs must often be adjustable in height, e.g. in order to customize or adjust the height of the tabletop or seating surface. Towards this end, the legs can, for example, be designed in a length-adjustable manner as telescopic supports. Locking means may be provided for fixing the extended position of the support column, and thereby the height of the support, and to secure the support column at its longitudinal extension in a set, extended position. For example, a splint may be inserted in bores provided along the longitudinal extension of the support. It is furthermore known that the support column itself may be designed as a spindle with a thread. The length adjustment can be implemented by unscrewing the spindle from a female support that is coupled to a portion of the tube profile.

The known supports, in particular, in the mounted state (e.g. those of a table) often include utilization of complex mechanisms or parts during manufacturing and assembly. Further, the known supports may be suspectible to unintentional shortening of the spindle, i.e. slipping through outer tube, in the case of accidental release of the respective locking, i.e. in the case of accidental release of the length adjustment. The task of this invention is to provide a length-adjustable support which avoids the disadvantages of prior art.

SUMMARY

The present invention may comprise one or more of the features recited in the attached claims, and/or one or more of the following features and combinations thereof. In a first example aspect, a bushing assembly is engageable with a spindle rod that extends along a spindle axis. The bushing assembly comprises a first bushing component comprising a first top surface, a first side surface that is formed to include a first spindle recess configured to be positioned radially around the spindle axis, a first latch element positioned along the first top surface and extending adjacent the first side surface, and a first latch aperture positioned along the first top surface. The bushing assembly comprises a second bushing component comprising a second top surface, a second side surface that is formed to include a second spindle recess configured to be positioned radially around the spindle axis, a second latch element positioned along the second top surface and extending adjacent the second side surface, and a second latch aperture positioned along the second top surface. The first and second bushing components are configured to be coupled together such that the first and second spindle recesses are positioned adjacent to each other to form a spindle aperture that the spindle rod extends through. The first latch aperture is configured to receive the second latch element, and the second latch aperture is configured to receive the first latch element, to secure the first and second bushing components together.

A second example aspect includes the first example aspect, and wherein the first side surface engages the second side surface when the first and second bushing components are coupled together.

A third example aspect includes the subject matter of the first example aspect, and wherein the bushing assembly further comprises a spindle plate configured to be coupled to the spindle rod, the spindle plate configured to engage with the first and second bushing components.

A fourth example aspect includes the subject matter of the third example aspect, and wherein the first bushing component further includes a first bottom surface that is formed to include a first plate-receiving aperture, and the second bushing component further includes a second bottom surface formed to include a second plate-receiving aperture, and wherein the first and second plate-receiving apertures receive the spindle plate and are positioned radially around the spindle axis when the first and second bushing components are coupled together.

A fifth example aspect includes the subject matter of the fourth example aspect, and wherein the spindle plate is configured to rotate with the spindle rod relative to the first and second bushing components, and the spindle plate rotates within the first and second plate-receiving apertures.

In an sixth example aspect, a spindle assembly may comprise a spindle tube formed to include a central passage, the spindle tube including a first end and a second end; a spindle rod that is configured to telescope into and out of the central passage at the first end of the spindle tube along a spindle axis; and a bushing assembly engageable with the spindle rod. The bushing assembly may comprise a first bushing component comprising a first top surface, a first side surface that is formed to include a first spindle recess configured to surround the spindle axis, and at least one of a latch element or a latch aperture positioned adjacent the first top surface. The bushing assembly may comprise a second bushing component comprising a second top surface, a second side surface that is formed to include a second spindle recess configured to surround the spindle axis, and the other of the latch element or latch aperture positioned adjacent the second top surface. The first and second spindle recesses are positioned adjacent to each other to form a spindle aperture that the spindle rod extends through. The latch aperture is configured to receive the latch element to secure the first and second bushing components together around the spindle rod.

A seventh example aspect includes the subject matter of the sixth example aspect, and wherein the spindle assembly further includes a spindle guide within the central passage of the spindle tube that engages with the spindle rod to facilitate telescoping the spindle rod into and out of the spindle tube.

An eighth example aspect includes the subject matter of the seventh example aspect, and wherein the spindle rod comprises an outside surface having male threading, and the spindle guide comprises an inside surface having female threading configured to mate with the male threading.

A ninth example aspect includes the subject matter of the eighth example aspect, and wherein the bushing assembly is configured to engage with the spindle rod along a bushing receiver section.

A tenth example aspect includes the subject matter of the sixth example aspect, wherein the bushing assembly further comprises a spindle plate configured to be coupled to the spindle rod to rotate therewith.

An eleventh example aspect includes the subject matter of the tenth example aspect, and wherein the spindle rod rotates to telescope into and out of the spindle tube, and wherein the spindle plate is configured to rotate within a plate aperture formed in the first and second bushing components when the spindle rod rotates.

A twelfth example aspect includes the subject matter of the tenth example aspect, and wherein the spindle plate is formed to include a spindle aperture that receives the spindle rod to rotate therewith.

A thirteenth example aspect includes the subject matter of the twelfth example aspect, and wherein the spindle rod includes a plate-receiving section, a bushing-receiving section, and a threaded section, and wherein the plate receiving section of the spindle rod is configured to extend within the spindle aperture of the spindle plate and is positioned between the bushing-receiving section and the threaded section.

A fourteenth example aspect includes the subject matter of the thirteenth example aspect, and wherein the plate-receiving section of the spindle rod and the spindle aperture of the spindle plate are hexagonal in shape.

A fifteenth example aspect includes the subject matter of the sixth example aspect, and wherein the spindle rod includes a bushing receiver section and a threaded section, and wherein the bushing receiver section is positioned between a first end of the spindle rod and the threaded section, and wherein the first and second bushing components correspond to the bushing receiver section of the spindle rod when the first and second bushing components are coupled around the spindle rod.

A sixteenth example aspect includes the subject matter of the sixth example aspect, and wherein the first and second bushing components are configured to be coupled together to form a bushing member around the spindle rod, and wherein the bushing member has an external perimeter that is larger than a perimeter of the spindle tube.

In a seventeenth example aspect, a motorized length-adjustable support comprises a motor assembly; a motor housing configured to support the motor assembly; and a telescopic column assembly comprising an exterior tube, an interior tube that is configured to telescope into and out of the exterior tube and is coupled to the motor housing, and a spindle assembly. The spindle assembly comprises a spindle tube coupled to the exterior tube; a spindle rod configured to telescope into and out of the spindle tube along a spindle axis, the spindle rod configured to be rotated by the motor assembly; and a bushing assembly that is engagable with the spindle rod near a first end of the spindle rod and connects the spindle rod to the motor housing. The bushing assembly comprises a first bushing component that is formed to include a first spindle recess that receives a portion of the spindle rod, the first spindle recess configured to be radially around the spindle axis. The bushing assembly comprises a second bushing component complimentary to the first bushing component that is formed to include a second spindle recess that receives a portion of the spindle rod, the second spindle recess configured to be radially around the spindle axis. A latch element is provided on either the first or second bushing components, or both, to connect the first and second bushing components together around the spindle rod.

An eighteenth example aspect includes the subject matter of the seventeenth example aspect, and further includes an adapter configured to be received on the first end of the spindle rod, the adapter engageable by a portion of the motor assembly to rotate the spindle rod.

A nineteenth example aspect includes the subject matter of the seventeenth example aspect, and wherein the spindle rod assembly further includes an interior spindle tube assembly that comprises an internal spindle tube and an internal receiving tube, the internal spindle tube including a lengthwise aperture through which the spindle rod telescopes into and out of during rotation of the spindle rod.

A twentieth example aspect includes the subject matter of the nineteenth example aspect, and wherein the internal spindle tube is configured to rotate and to telescope into and out of the spindle tube of the spindle assembly to cause the spindle rod assembly to telescope into and out of the spindle tube of the spindle assembly.

DESCRIPTION OF THE ILLUSTRATIVE EMBODIMENTS

For the purposes of promoting an understanding of the principles of the invention, reference will now be made to a number of illustrative embodiments shown in the attached drawings and specific language will be used to describe the same. The figures of the drawings show the object according to the invention as strongly schematized and are not to be taken to scale. The individual components of the object according to the invention are represented such that their design can be easily seen.

Figure 1:
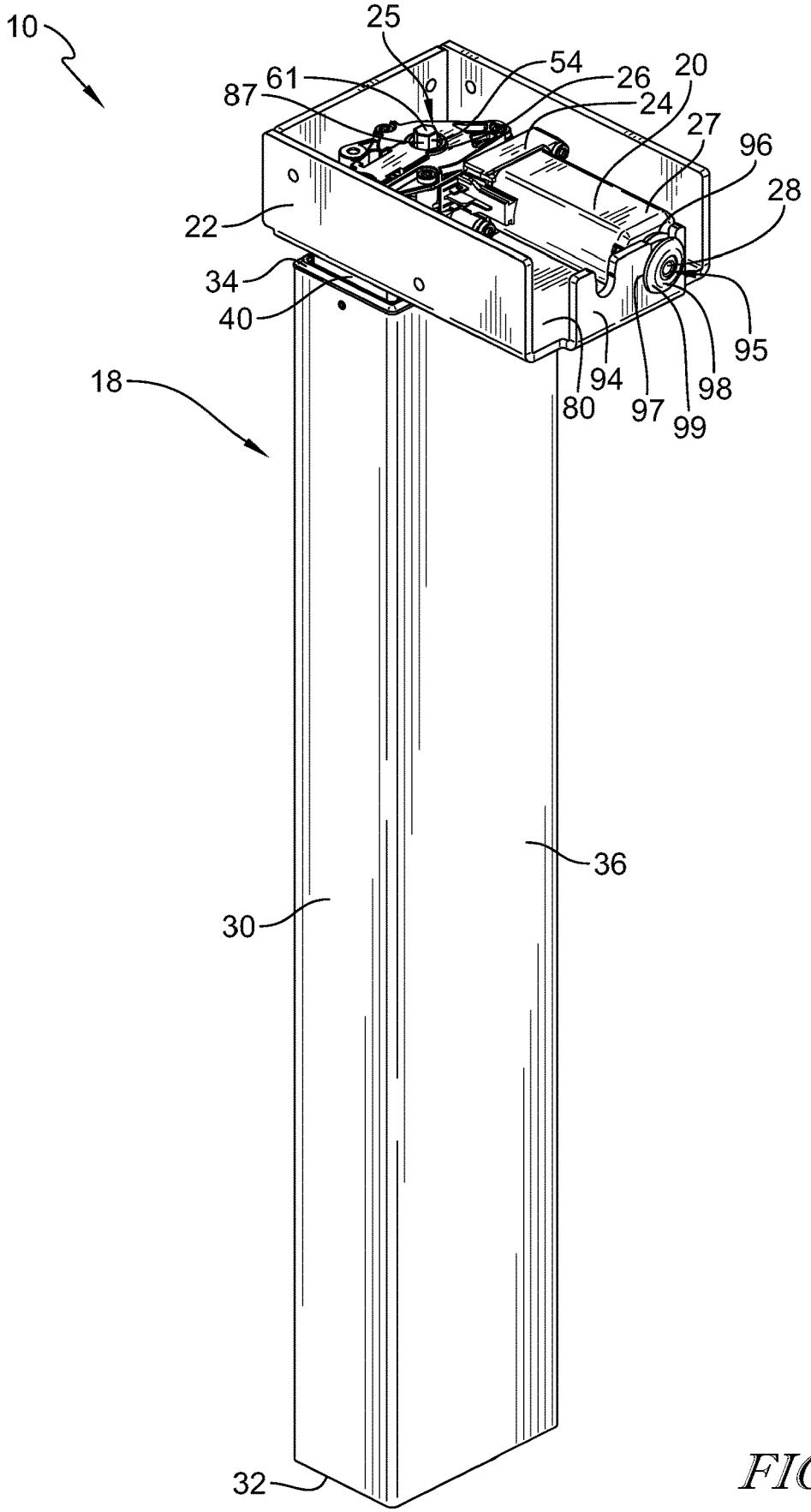
FIG. 1 is a side perspective view of an exemplary embodiment of a length-adjustable support of the present disclosure, the length-adjustable support including a telescopic column assembly, a motor housing and a motor contained with the motor housing and configured to adjust the length of the length-adjustable support.
Figure 2:
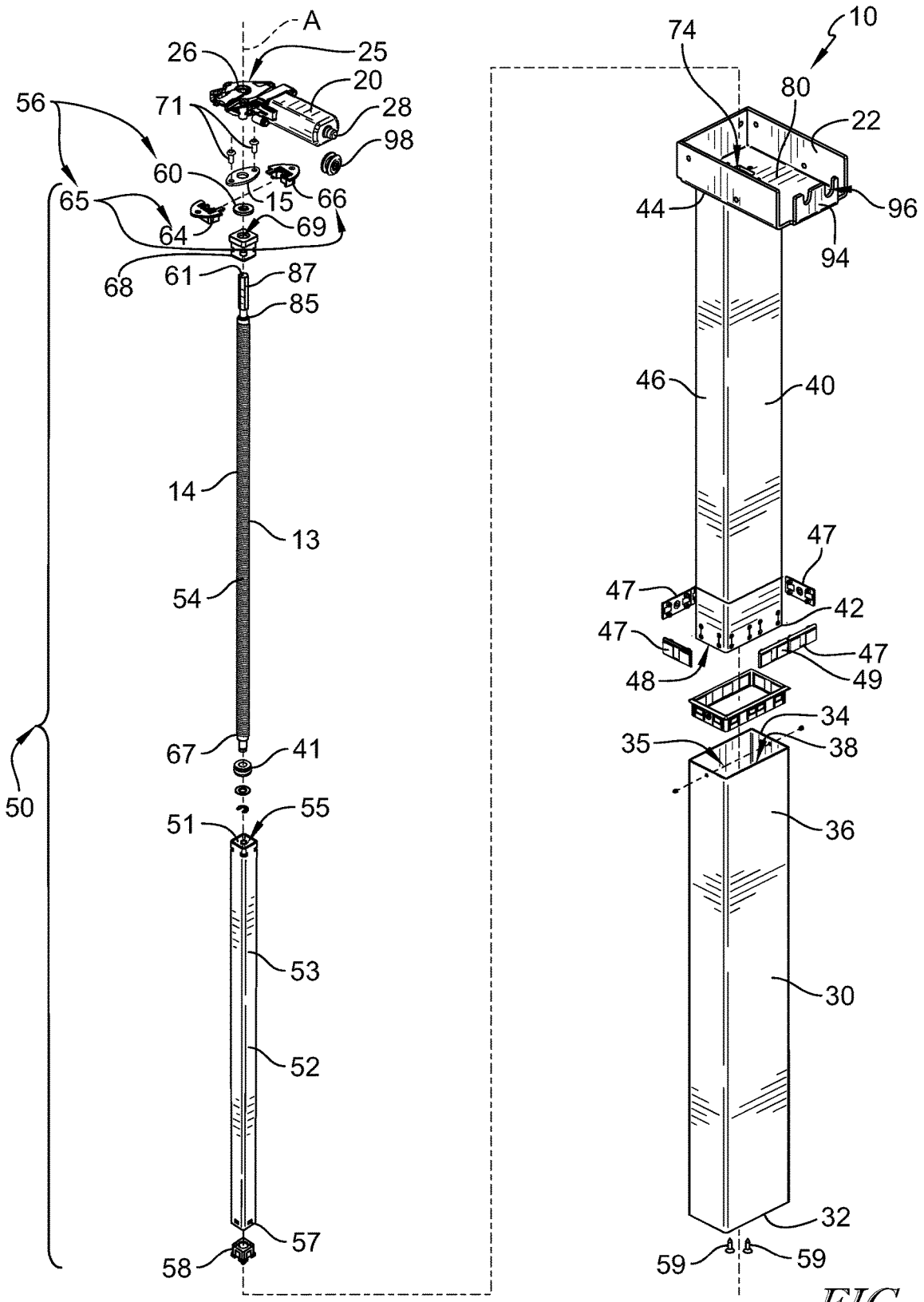
FIG. 2 is an exploded view of the length-adjustable support of FIG. 1, showing the motor housing attached to a top portion of the telescopic column assembly and a spindle assembly of the telescopic column assembly is engaged by the motor to operate adjustment of the length-adjustable support.
Figure 3A:
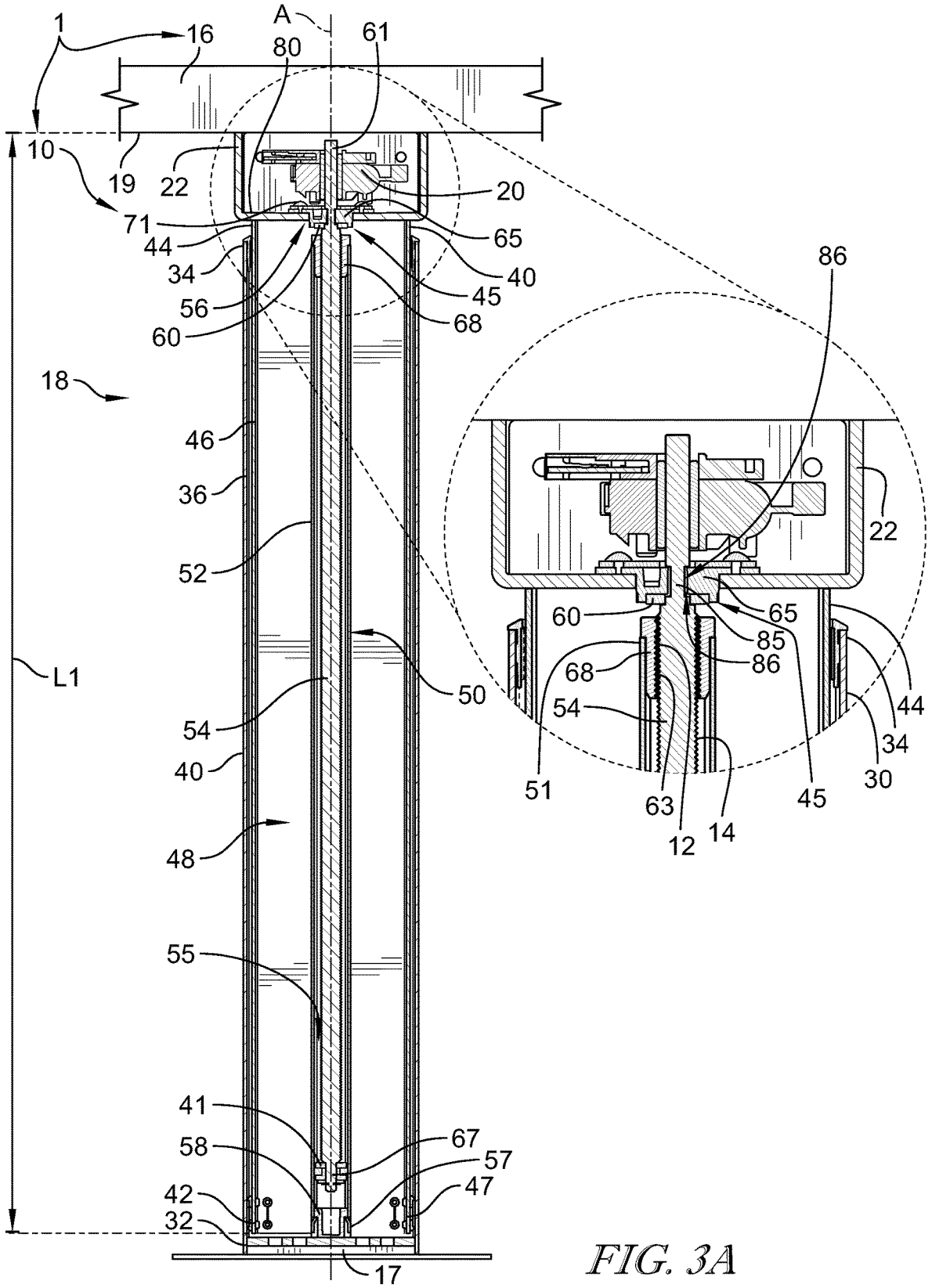
FIG. 3A is a front perspective, cross-sectional, view of the length-adjustable support of FIG. 1, showing the support in a collapsed position and illustrating the spindle assembly extends through the motor housing and into a tube of the telescopic column assembly.
Figure 3B:
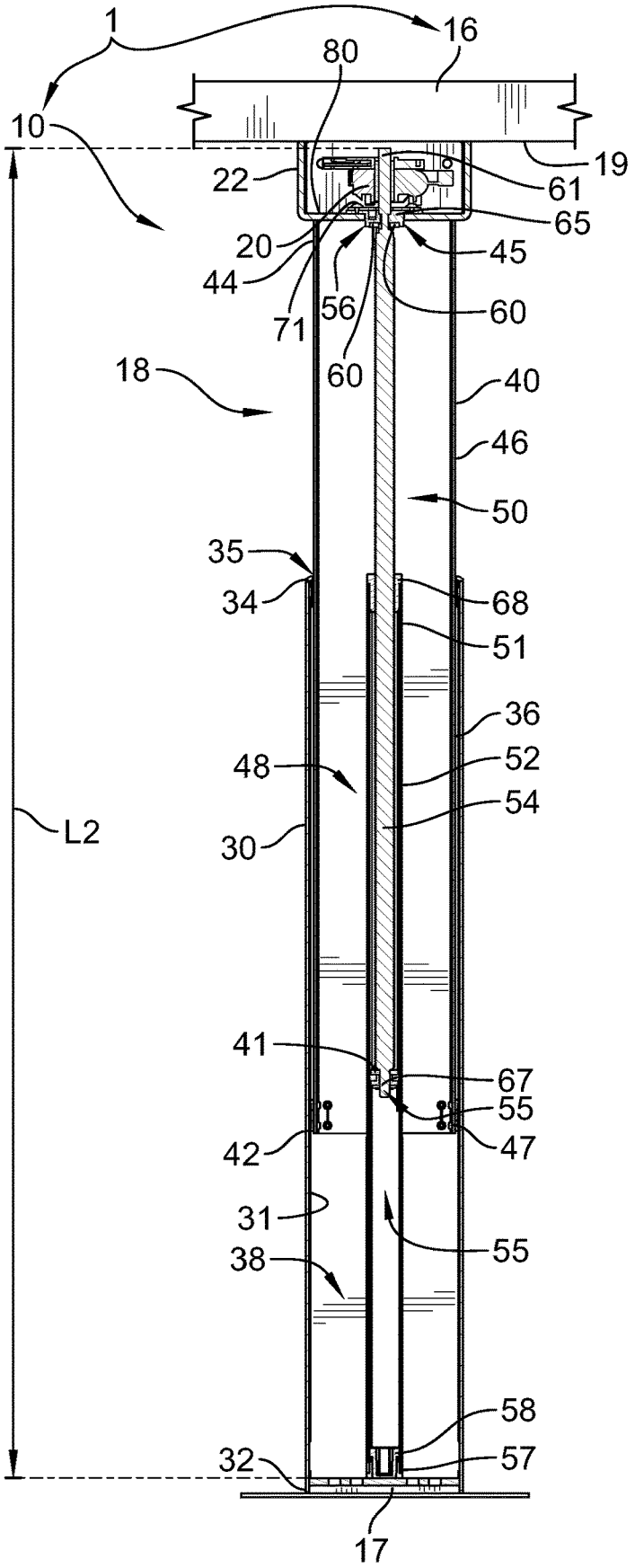
FIG. 3B is a front perspective, cross-sectional view of the length-adjustable support of FIG. 1 after it has been moved from the collapsed position to an extended position, illustrating the spindle assembly includes a rod that telescopes out of a housing in order to extend the telescopic column assembly to the extended position.

Referring now to FIGS. 1 to 3B, a first illustrative embodiment of a length-adjustable support 10 is shown. Illustratively, FIGS. 3A-3B shows a support 10 according to an illustrative embodiment of the present disclosure as a leg that supports a desk or work surface 16, such as a table top, a desk surface or other horizontal member. In various embodiments, there may be four or more length-adjustable supports 10 coupled to a single work surface 16 to form a table assembly 1. In illustrative embodiments, the support 10 may be directly coupled to the work surface 16, as illustrated in FIGS. 3A-3B, via one or more set screws (not shown), or alternatively, the support 10 may be coupled to the work surface 16 via a fixing plate (not shown) attached to an upper end of the support 10. The fixing plate may also be mounted to the work surface 16 via one or more screws. A ground plate 17 may be coupled to a lower end of the support 10 in order to provide the support 10 means to stand or stabilize the table assembly 1 on the floor (not shown) when the table assembly is positioned on the floor. The ground plate 17 may be mounted to the free lower end of a support 10 in any known manner.

In illustrative embodiments, one or more of the supports 10 of the table assembly 1 includes a telescopic column assembly 18, a motor assembly 20, and a motor housing 22, as illustrated in FIGS. 1-3. The motor assembly 20 is configured to cause the telescopic column assembly 18 to convert from a collapsed position to an extended position to adjust the length of the support 10 in order to, for example, adjust the height of the work surface 16. In particular, the motor assembly 20 is configured to drive portions of the column assembly 18, discussed below, to telescope with respect to each other to change the length of the column assembly 18. The motor housing 22 is configured to house a portion of the motor assembly 20 and be coupled to a bottom surface 19 of the work surface 16. In various embodiments, the column assembly 18 is configured to extend between the ground plate 17 and the motor housing 22 and be coupled thereto.

Figure 4:
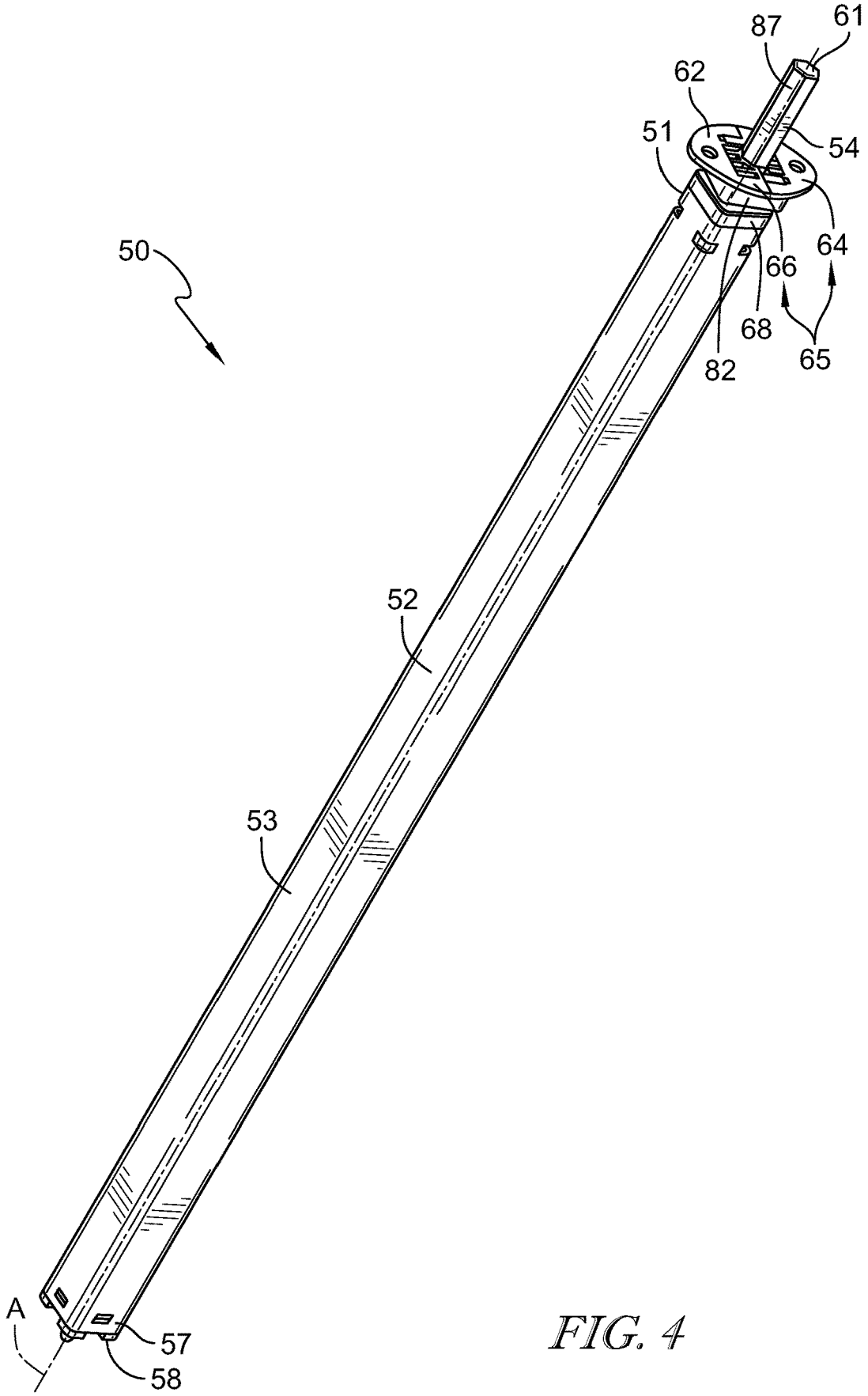
FIG. 4 is a side perspective view of the spindle assembly of FIG. 2, illustrating the rod of the spindle assembly extends into the housing of the spindle assembly and a bushing assembly is coupled to a top section of the rod that extends outside of the housing.

An illustrative embodiment of the column assembly 18 will now be described. As illustrated in FIGS. 2-4, the column assembly 18 includes an exterior tube 30, an interior tube 40 configured to telescopically extend into and out of the exterior tube 30, and a spindle assembly 50 configured to extend through a portion of the interior tube 40 and with a portion of the spindle assembly 50 coupled thereto. The spindle assembly 50 is configured to be driven by the motor assembly 20 in order to cause the interior tube 40 to telescope out of the exterior tube 30 in order to adjust the length of the column assembly 18. Alternative configurations are envisioned herein. In another illustrative embodiment, the exterior tube 30 may be configured to telescopically extend over the interior tube 40, with a portion of the spindle assembly 50 coupling to a portion of the exterior tube 30 and/or the motor housing 22. In such an embodiment, the spindle assembly 50 is configured to be attached to the ground plate 17 that is attached to the interior tube 40.

In the illustrative embodiment shown in FIGS. 2-3B, the exterior tube 30 includes a first end 32, a second end 34, and a tube housing 36 that extends between the first and second ends 32 and 34. The tube housing 36 defines a central passage 38 of the exterior tube 30 that extends from the first end 32 to the second end 34. The central passage 38 is configured to receive the interior tube 40 such that the tube housing 36 surrounds the interior tube 40 when the column assembly 18 is in the collapsed state. The first end 32 of the exterior tube 30 is illustratively coupled to the ground plate 17, or the ground plate 17 may be formed homogenously with the first end 32. The second end 34 of the exterior tube 30 is formed with an opening 35 through which the interior tube 40 telescopes through as it travels from the central passage 38 in order to extend the length of the column assembly 18.

The interior tube 40 includes a first end 42, a second end 44, and a tube housing 46 that extends between the first and second ends 42 and 44. The tube housing 46 is configured to be received within the central passage 38 of the exterior tube 30 when the interior tube 40 is telescoped within the exterior tube 30. In illustrative embodiments, the tube housing 46 of the interior tube 40 is similar in shape or dimension as the tube housing 36 of the exterior tube 30, although the tube housing 46 may be necessarily smaller than the tube housing 36. The tube housing 46 defines a central passage 48 of the interior tube 40 that extends from the first end 42 to the second end 44. The central passage 48 is configured to receive the spindle assembly 50 such that the tube housing 46 surrounds the spindle assembly 50. The first end 42 of the interior tube 40 is configured to be near the first end 32 of the exterior tube 30 when the column assembly 18 is in the collapsed state, as illustrated in FIG. 3A. Similarly, the second end 44 of the interior tube 40 is configured to be near the second end 34 of the exterior tube 30 when the column assembly 18 is in the collapsed state as illustrated. However, the interior tube 40 is configured to be movable within the central passage 38 of the exterior tube 30 such that the first end 42 is moved away from the first end 32 of the exterior tube 30 when the interior tube 40 telescopes out of the exterior tube 30. Similarly, the second end 44 is moved away from the second end 34 when telescoping occurs. Accordingly, the first end 42 of the interior tube 40 is not coupled to the first end 32 or the ground plate 17. The spindle assembly 50 extends through the first end 42 of the interior tube 40 such that the first end 42 may provide an opening into the central passage 48. The first end 42 may otherwise be substantially enclosed, or may include a larger opening into the central passage 48. The second end 44 of the interior tube 40 is illustratively coupled to the motor housing 22, or it may be formed homogeneously with the motor housing 22.

In illustrative embodiments, the tube housing 46 of the interior tube 40 may further include one or more slide guides 47 positioned along an exterior surface of the housing 46. The slide guides 47 may include an exterior surface that is configured to engage with an interior surface 31 of the tube housing 36 of the exterior tube 30 as the interior tube 40 travels through the central passage 38 of the exterior tube 30. The slide guides 47 are configured to assist with guiding the interior tube 40 when it telescopes out of the exterior tube 30 in order to provide a smooth feel to the telescoping operation. As understood by one of skill in the art, other guide options, such as a rolling element guide, could also be incorporated between the interior and exterior tubes 30 and 40. Such other guide options are envisioned herein as well. In illustrative embodiments, the slide guides 47 may be positioned adjacent the first end 42, the second end 44, or both, of the interior tube 40. Other locations for such guides 47 are envisioned herein as well.

The spindle assembly 50 is coupled to both the exterior tube 30 and the interior tube 40 and is configured to be driven by the motor assembly 20 to telescope the interior tube 40 out of the central passage 38 of the exterior tube 30. In illustrative embodiments, the spindle assembly 50 is configured to extend through a spindle opening 45 in the second end 44 of the interior tube 40 and into the central passage 48 of the interior tube 40. Functionally, a portion of the spindle assembly 50 is coupled to the second end 44 of the interior tube 40. Another portion of the spindle assembly 50 is coupled to the first end 32 of the exterior tube 30, or it may be alternatively coupled to the ground plate 17. The spindle assembly 50 is configured to extend in length from a first length L1 to a second length L2, thereby causing the interior tube 40 to telescope out of the exterior tube 30 to extend the length of the column assembly 18. The spindle assembly 50 is generally positioned along a spindle axis A, as illustrated in FIGS. 3-4.

The spindle assembly 50 includes a spindle tube 52, a spindle rod 54, and a bushing assembly 56, as illustrated in FIGS. 2 and 4. The spindle tube 52 includes a spindle housing 53 that is formed to include a central passage 55 through which the spindle rod 54 extends. In various embodiments, the spindle housing 53 has a square cross-sectional profile, although other shapes or forms of the spindle housing 53 are envisioned herein. The spindle housing 53 is configured to extend along and substantially surround the spindle axis A. The spindle tube 52 is configured to be attached to the ground plate 17 or first end 32 of the exterior tube 30. The spindle tube 52 includes a first end 51 and a second end 57, with the central passage 55 extending therebetween. The second end 57 may generally correspond in vertical location with the first end 32 of the exterior tube 30, and the first end 51 may generally correspond in vertical location with the second end 34 of the exterior tube 40. The spindle tube 52 is illustratively fixed relative to the exterior tube 40, as illustrated in FIGS. 3A-3B In illustrative embodiments, the spindle tube 52 is connected to the ground plate 17 via a square nut or attachment bracket 58. The attachment bracket 58 may be integrally part of the spindle tube 52, or may be a separate component as illustrated in FIG. 2. The attachment bracket 58 may be configured to be partially received within the central passage 55 of the spindle tube 52 adjacent the second end 57 of the spindle tube 52. The attachment bracket 58 may be formed to frictionally engage with an interior surface of the spindle housing 53 to retain the attachment bracket 58 in connection with the spindle tube 52. The attachment bracket 58 may also be held in place by a crimping operation performed on the spindle tube 52 after the attachment bracket 58 has been inserted thereon. The attachment bracket 58 may be coupled to the ground plate 17 via any suitable means. For example, the attachment bracket 58 may be secured to the ground plate 17 via one or more set screws 59, as illustrated in FIG. 2. The spindle tube 52 may be otherwise unconnected from the interior tube 40. Accordingly, the spindle tube 52 will generally move with the exterior tube 30 and will telescope through or out of the interior tube 40 when the interior tube 40 telescopes out of the central passage 38 of the exterior tube 30.

The spindle rod 54 is configured to be received within the central passage 55 of the spindle tube 52 and extends substantially along spindle axis A. The spindle rod 54 is configured to rotate within the central passage 55 during operation of the spindle assembly 50 to change the length of the length-adjustable support 10. In particular, rotation of the spindle rod 54 is configured to telescope the spindle rod 54 into and out of the central passage 55 of the spindle tube 52.

As illustrated in FIGS. 2-3, the spindle rod 54 is received within the central passage 55 of the spindle tube 52. The spindle rod 54 is configured to be attached or fixed relative to the motor housing 20, which in turn is attached or fixed relative to the interior tube 40. The spindle rod 54 includes a first end 61 and a second end 67. The first end 61 may generally correspond in location with the motor housing 22 that is adjacent the second end 44 of the interior tube 40. The second end 67 may generally correspond in location with the second end 57 of the spindle tube 52 when the length-adjustment support 10 is in the collapsed position, but may be moved away from the second end 57 towards the first end 51 when the spindle assembly 50 is moved to an extended position. For instance, the second end 67 is not secured to the second end 57 of the spindle tube 52, and the first end 61 is not secured to the first end 51 of the spindle tube 52. Instead, the spindle rod 54 is configured to telescope within the spindle tube 52. The spindle rod 54 may include one or more bumpers 41 that facilitate smooth movement of the spindle rod 54 as it telescopes within the spindle tube 52.

In illustrative embodiments, a spindle guide 68 may be illustratively coupled to the first end 51 of the spindle tube 52. The spindle guide 68 is configured to receive the spindle rod 54 while permitting the spindle rod 54 to move with respect to the spindle tube 52. The spindle guide 68 may be positioned adjacent the first end 51 of the spindle tube 52, or may alternatively be located at other locations along the spindle tube 52. The spindle guide 68 illustratively provides a guide means for the spindle rod 54 as it telescopes within the spindle tube 52 by providing engagement between the spindle guide 68 and the spindle rod 54.

Illustratively, the spindle guide 68 includes a central passage 69 that is formed by an interior surface 63 of the spindle guide 68 to permit the spindle rod 54 to pass through, as illustrated in FIGS. 2-3B. The interior surface 63 of the spindle guide 68 is configured to engage with a mating section 13 of the spindle rod 54 to permit the spindle rod 54 to rotate within the spindle guide 68 as the spindle guide 68 remains substantially fixed and coupled to the spindle tube 52. In illustrative embodiments, the mating section 13 of the spindle rod 54 includes male threading 14 and the interior surface 63 of the spindle guide 68 includes female threading 12 that receives the male threading 14 of the spindle rod 54. As the spindle rod 54 rotates, the male threading 14 travels through the female threading 12, effectively lengthening or reducing the distance from the first end 61 of the spindle rod 54 to the second end 57 of the spindle tube 52. Length adjustment of the spindle assembly 50 may accordingly be achieved.

In an exemplary embodiment, the spindle guide 68 is coupled to and configured to engage with an interior surface of the spindle tube 52 or otherwise provide the spindle tube 52 passage therethrough. Accordingly, the spindle rod 54 may be inserted through the central passage 69 of the spindle guide 68 and the central passage 55 of the spindle tube 52. Other means of securing the spindle guide 68 to the tube 52 are envisioned herein. Alternatively, the spindle guide 68 may be integrally formed with the first end 51 of the spindle tube 52. In assembly, the second end 67 of the spindle rod 54 may be threadingly received within the central passage 69 of the spindle guide 68 and then pass into the central passage 55 of the spindle tube 52. The spindle rod 54 may be rotated in order to be inserted into the central passage 55 in order to cause the male and female threading 12 and 14 to engage with each other. The spindle rod 54 may be rotated until a pre-determined length of male threading 14 is traversed. This may occur when the length-adjustment support 10 is in the collapsed state, for example.

Figure 9:
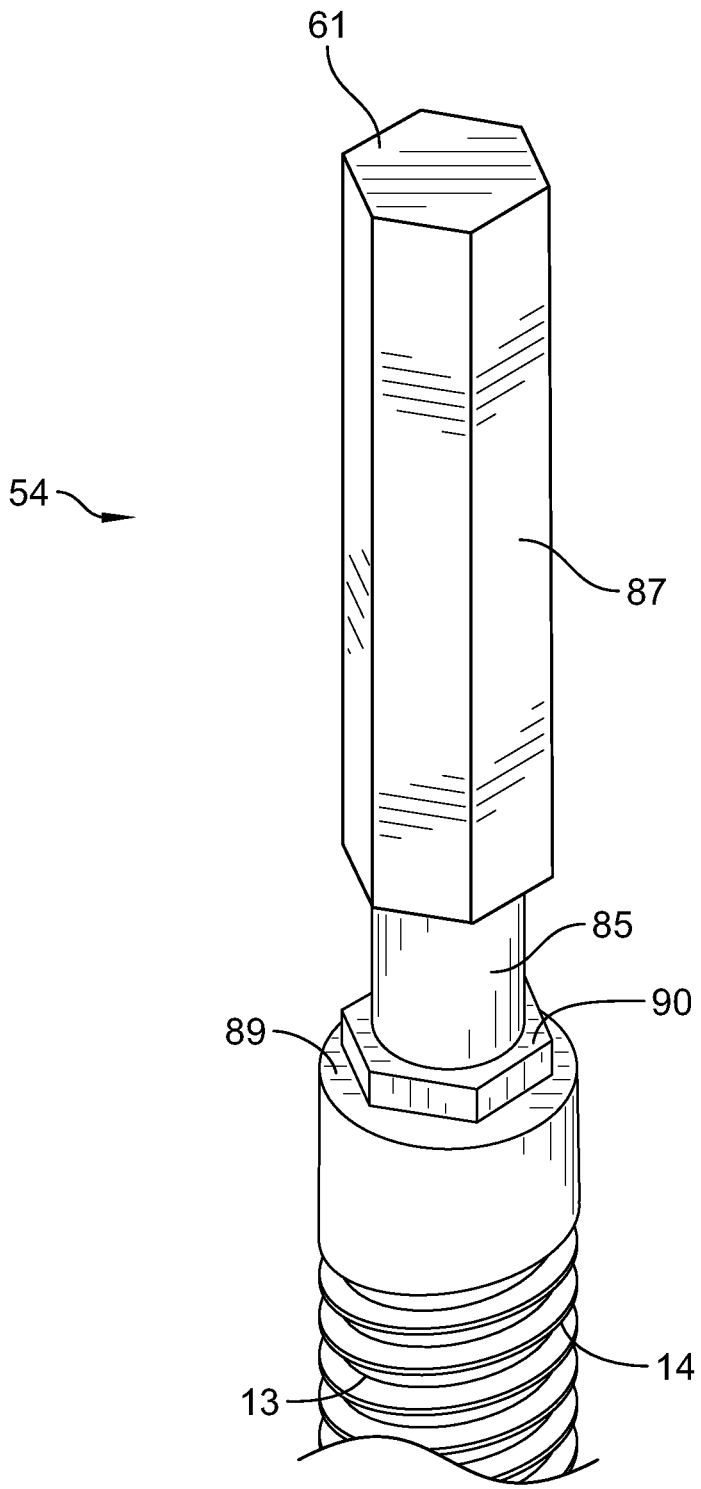
FIG. 9 is a side perspective view of a top portion of the rod of the spindle assembly, showing the rod includes different portions or sections that are configured to engage or be aligned with the motor assembly, the bushing assembly of the spindle assembly, and a spindle guide of the spindle assembly.

A portion of the spindle rod 54 adjacent the first end 61 is illustrated in FIG. 9. As shown, the spindle rod 54 includes a plate receiver section 90, a bushing receiver section 85, and a motor-engaging section 87. In illustrative embodiments, the motor-engaging section 87 is adjacent the first end 61 of the spindle rod 54, the bushing receiver section 85 is adjacent the motor-engaging section 87, and the plate receiver section 90 is adjacent the bushing receiver section 85. The plate receiver section 90 may further be adjacent to the mating section 13 of the spindle rod 54. The plate receiver section 90, bushing receiver section 85 and motor-engaging section 87 will be described in more detail below.

Illustratively, the spindle rod 54 is received by the spindle driver 26 of the motor assembly 20 that is contained within the motor housing 22 (which in turn is secured to the interior tube 40), as illustrated in FIGS. 3A-3B. Accordingly, as the spindle rod 54 is driven out of the spindle tube 52, for example, by the motor assembly 20, the spindle assembly 50 extends in length, causing the motor housing 22 to move upward and the interior tube 40 to telescope out of the exterior tube 30, increasing the length of the length-adjustment support 10.

In an illustrative embodiment, the spindle rod 54 is coupled to the motor housing 22 via at least the bushing assembly 56. The bushing assembly 56 includes a bushing member 65 and a spindle plate 60 that is receivable by the bushing member 65. The bushing member 65 is configured to permit rotation of the spindle rod 54 therethrough adjacent the bushing receiver section 85. The spindle plate 60 is configured to surround the spindle rod 54 below the bushing member 65 and may be positioned adjacent the plate receiver section 90 of the spindle rod 54. In various embodiments, the spindle plate 60 could be a washer, hex washer or ring, although other embodiments are envisioned herein. The bushing member 65 may be comprised of metal, plastic or other suitable material, and the spindle plate 60 may be comprised of metal, plastic or other suitable material. Both the bushing member 65 and the spindle plate 60 are configured to be aligned around the spindle axis A.

Figure 5A:
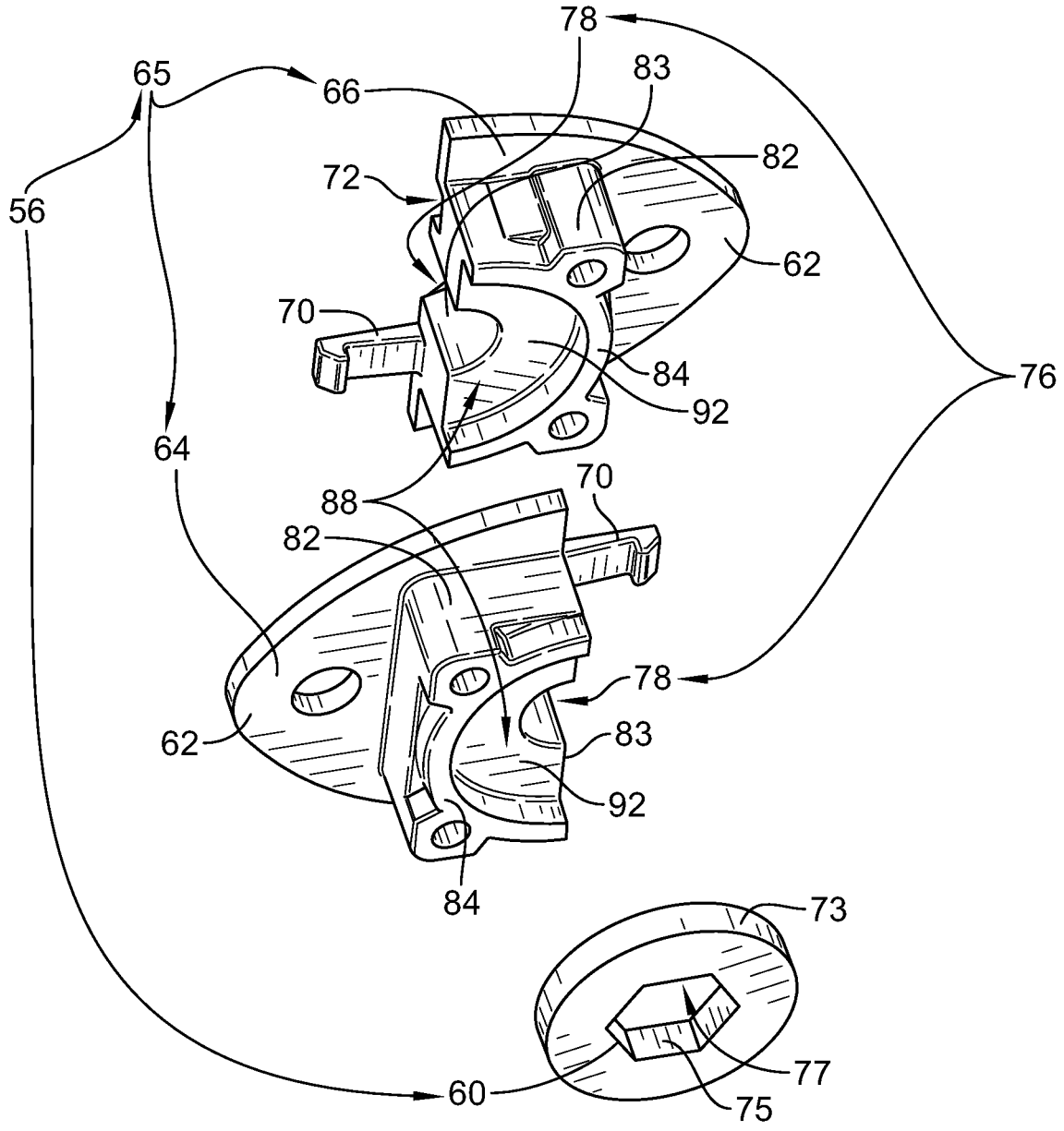
FIG. 5A is a bottom perspective, exploded view of an exemplary embodiment of the bushing assembly of FIG. 4, illustrating the bushing assembly includes first and second bushing components that are configured to be coupled together around the spindle rod and a spindle plate that is receivable within a portion of the bushing components.
Figure 5B:
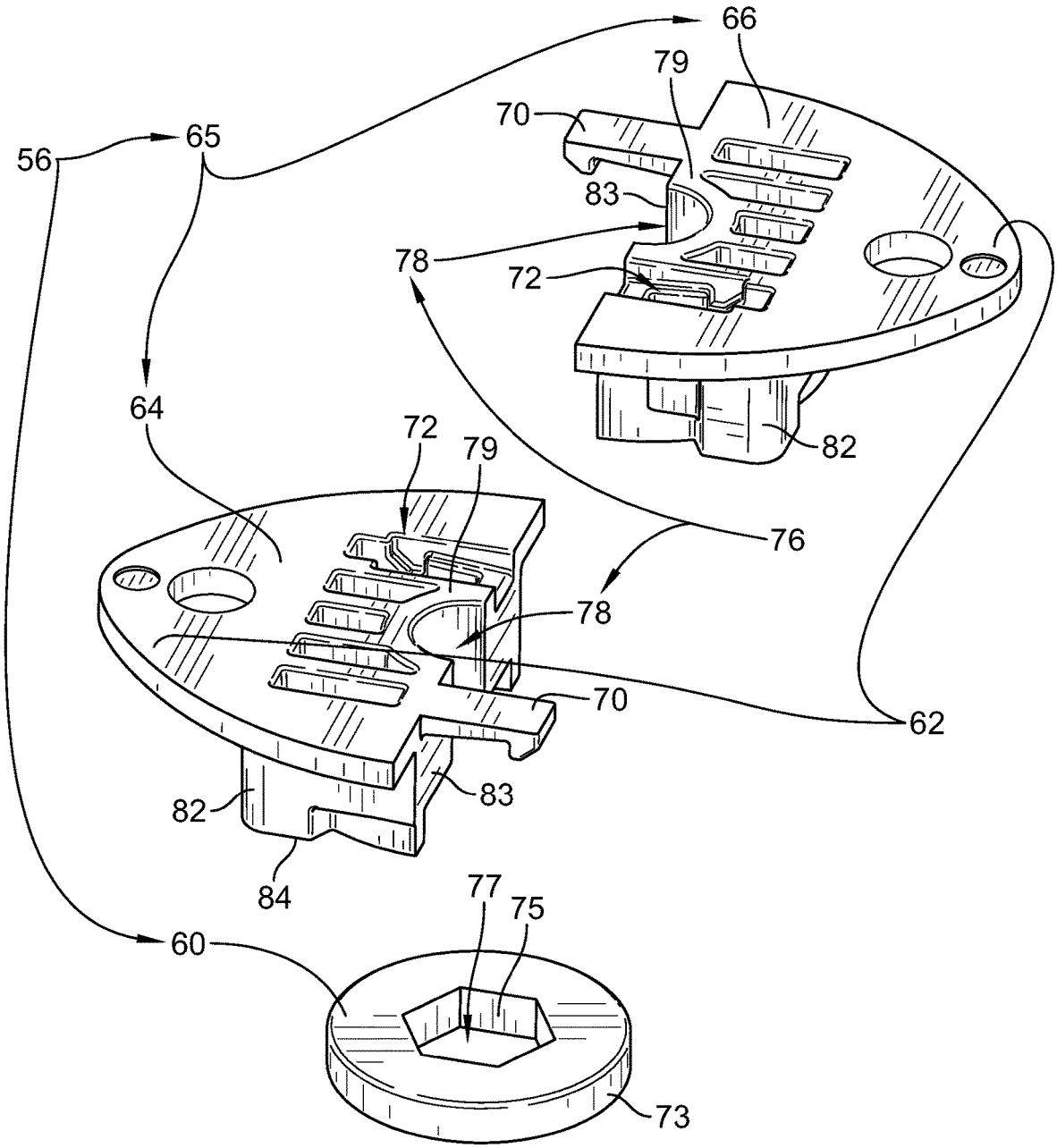
FIG. 5B is a top perspective view of the bushing assembly of FIG. 5A, illustrating the first and second bushing components may include complimentary latch elements and apertures to receive the latch elements in order to couple the first and second bushing components together.

In illustrative embodiments, the bushing member 65 is formed by a first bushing component 64 and a second bushing component 66. The first and second bushing components 64 and 66 are complimentary to each other and configured to be joined together to surround the spindle rod 54 adjacent the bushing receiver section 85. In one embodiment, the bushing components 64 and 66 may be secured together via one or more clips 70 that extend from the first bushing component 64 and are received within one or more latch apertures 72 in the second bushing component 66. Similarly, there may be one or more latches or clips 70 that extend from the second bushing component 66 and are received within one or more latch apertures 72 within the first bushing component 64. In various embodiments, each bushing component 64 and 66 may include a clip 70 that is positioned along opposite sides of the spindle axis A when the bushing assembly 56 is coupled to the spindle rod 54, as illustrated in FIGS. 5A-5B. Other locations for means to secure the two bushing components 64 and 66 are envisioned herein.

Figure 6:
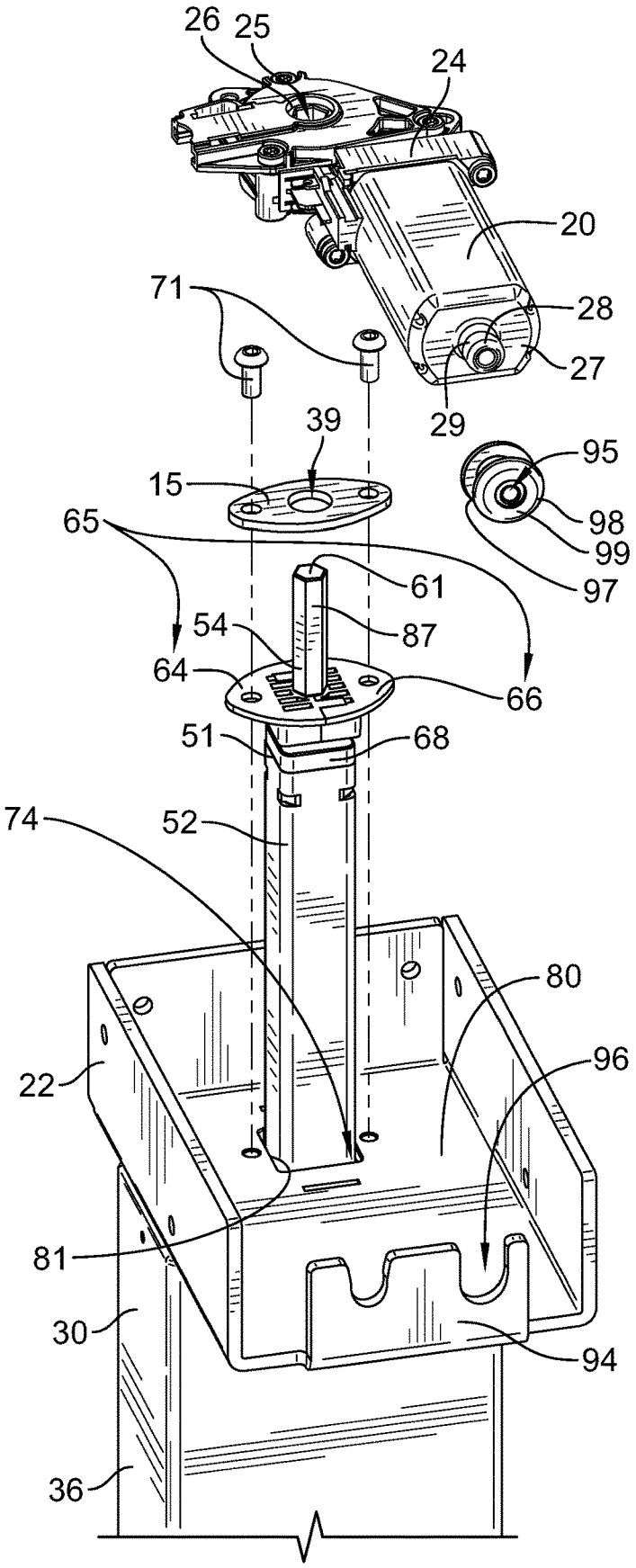
FIG. 6 is a partially exploded view of a top portion of the length-adjustable column of FIG. 1, illustrating how the spindle assembly and motor assembly are coupled to the motor housing, and that the motor assembly is coupled to a side flange of the motor housing via a fastener that secures and suspends the motor assembly within the housing by securing an arm of the motor housing to the side flange.

The first and second bushing components 64 and 66 are configured to be secured together around the bushing receiver section 85 of the spindle rod 54 within the motor housing 22. As illustrated in FIGS. 3A-3B and 6, the spindle tube 52 and spindle rod 54 are configured to extend and slide through a spindle aperture 74 within a bottom side 80 of the motor housing 22 in order to be received within the interior tube 40. In illustrative embodiments, the first and second bushing components 64 and 66 are coupled together to form the bushing member 65 within the motor housing 22 such that a top ledge 62 of the bushing member 65 has a perimeter that is larger than the spindle aperture 74. Accordingly, the top ledge 62 of the bushing member 65 may abut against the bottom side 80 of the motor housing 22 to prevent the spindle assembly 50 from traveling through the spindle aperture 74. In various embodiments, the bushing member 65 may be secured to the bottom side 80 of the motor housing 22 via one or more bolts or set screws 71 that extend through apertures in the top ledge 62, as illustrated in FIG. 6, although other forms of mounting are envisioned herein. A support plate 15 may be provided between the bolts 71 and the bushing member 65 to add strength to the bushing member 65 (which may be comprised of plastic) during application of force upon the bushing member 65 during operation of the length-adjustment support. The support plate 15 may be formed of plastic or metal in illustrative embodiments, although other materials are envisioned herein, and includes a support aperture 39 through which the spindle rod 54 can extend.

In exemplary embodiments, the bushing member 65 may be formed to include a connector plug 82 that is receivable within the spindle aperture 74 of the motor housing 22. The connector plug 82 may extend through the spindle aperture 74 and engage against an inner surface 81 that forms the spindle aperture 74 in the bottom side 80, such that the bushing member 65 is wedged in or frictionally attached to the bottom side 80. In various embodiments, the first and second bushing components 64 and 66 may each include a portion of the connector plug 82. The connector plug 82 of the bushing member 65 provides means for making the bushing member 65 a rotation-resistant mating part for the spindle rod 54 and secured against displacement in the longitudinal direction by connection with the bottom side 80 of the motor housing 22.

The first and second bushing components 64 and 66 each include a spindle recess 78 along an interior surface 83 of the bushing components 64 and 66. When the first and second bushing components 64 and 66 are coupled together along their interior surfaces 83 to form the bushing member 65, the spindle recesses 78 are aligned together to form a spindle aperture 76 through which the bushing receiver section 85 of the spindle rod 54 extends. The spindle aperture 76 is configured to permit the bushing receiver section 85 of the spindle rod 54 to rotate within the spindle aperture 76 of the bushing member 65. In illustrative embodiments, the bushing receiver section 85 may be configured as having a circular cross-sectional shape to facilitate rotation of the spindle rod 54 within the bushing member 65. The bushing receiver section 85 may include a smooth exterior surface, as illustrated in FIG. 9, or may include a threaded or partially-machine threaded surface.

In various embodiments, the spindle rod 54 is formed such that the bushing receiver section 85 extends through the spindle aperture 76 with a clearance space 86 between the bushing receiver section 85 and the interior surfaces 83 forming the spindle aperture 76 within the bushing member 65, as illustrated in FIG. 3A. Such a design may eliminate or reduce frictional engagement between the bushing receiver section 85 of the spindle rod 54 and the bushing components 64 and 66 while the spindle rod 54 rotates. In other embodiments, there may be little to no clearance space between the interior surfaces 83 and the bushing receiver section 85 as long as the spindle rod 54 is capable of rotating within the spindle aperture 76. The bushing receiver section 85 is adjacent to the motor-engaging section 87 at the first end 61 of the spindle rod 54. The spindle aperture 76 is sized and configured to permit rotation of the bushing receiver section 85 within the bushing member 65, but is not large enough to permit the motor-engaging section 87 to extend therethrough. Accordingly, the motor-engaging section 87 will abut against the top surfaces 79 of the top ledge 62 of the bushing member 65 when the spindle rod 54 extends through the spindle aperture 76, blocking additional movement of the spindle rod 54 therethrough.

The bushing member 65 further includes a bottom surface 84 spaced away from the top surface 79 and is formed to include a plate-receiving aperture 88. The plate-receiving aperture 88 is configured to extend radially around the spindle axis A and receive the spindle plate 60 when the spindle plate 60 is received on the spindle rod 54. In particular, the plate-receiving aperture 88 extends radially outside of the spindle plate 60 when the spindle plate 60 is positioned adjacent the plate receiver section 90 of the spindle rod 54. The plate-receiving aperture 88 is shaped or configured to permit the spindle plate 60 to rotate within the bushing member 65. The bushing member 65 further includes a stop surface 92 that defines an upper boundary of the plate-receiving aperture 88 to block movement of the spindle plate 60. The stop surface 92 illustratively functions as a bearing surface along which the spindle plate 60 rotates when the spindle rod 54 rotates within the bushing member 65. In various embodiments, the plate-receiving aperture 88 has a circular cross-section, although other shapes or configurations are envisioned herein.

The spindle plate 60 illustratively serves to transfer and distribute a load or force from the bushing member 65 upon the spindle rod 54, or vice versa, during adjustment of the length-adjustment support 10 from the collapsed position to the extended position or vice versa. In addition, the spindle plate 60 may provide a reduction in the friction, and thus rotational resistance, when turning the spindle rod 54. The spindle plate 60 is illustratively circular in nature and includes an exterior perimeter surface 73 and an interior perimeter surface 75. The exterior surface 73 may be formed to be complimentary to the plate-receiving aperture 88 of the bushing member 65. The interior surface 75 is configured to form a spindle aperture 77 through the spindle plate 60 through which a portion of the spindle rod 54 extends.

The spindle plate 60 is positioned adjacent the plate receiver section 90 of the spindle rod 54 and the design of the spindle plate 60 is formed to maintain the spindle plate 60 at the plate receiver section 90 during operation of the length-adjustment support 10. In particular, and illustratively, the spindle plate 60 may abut against or engage with a ledge or step portion 89 of the spindle rod 54 that is below the plate receiver section 90 when the spindle rod 54 is inserted into the spindle aperture 77. The ledge 89 may be configured to have a larger diameter than the spindle aperture 77 formed by the interior surface 75 of the spindle plate 60, thereby blocking or preventing downward movement of the spindle plate below the plate receiver section 90. As noted, the spindle plate 60 is further prevented from upward movement by the stop surface 92 of the bushing member 65. Accordingly, the spindle plate 60 is effectively retained at a pre-determined position along the spindle rod 54 and spindle axis A.

Further, the interior surface 75 of the spindle plate 60 may be formed to be complimentary to the plate receiver section 90 of the spindle rod 54. In an illustrative embodiment, the plate receiver section 90 may have a hexagonal cross-sectional shape, and the interior surface 75 may similarly be shaped to compliment a hexagonal shape. Other complimentary shapes are envisioned herein. The complimentary shape of the interior surface 75 and the plate receiver section 90 cause the spindle plate 60 to rotate about the spindle axis A when the spindle rod 54 rotates. Accordingly, the spindle plate 60 moves with the spindle rod 54 and rotates about the spindle axis A as the spindle rod 54 rotates, rotating within the plate-receiving aperture 88 of the bushing member 65. Because the spindle plate 60 is substantially fixed at the plate receiver section 90 due to the stop surface 92 of the bushing member 65 and the ledge 89 of the spindle rod 54, the spindle rod 54 does not move laterally up and down or telescope with respect to the bushing member 65 or the motor housing 22, but is still free to be rotated with respect to such components.

Illustratively, the cross-sectional shapes of the plate receiver section 90 of the spindle rod 54 (and therefore also the interior surface 75 of the spindle plate 60) may be different than the cross-sectional shape of the bushing receiver section 85 of the spindle rod 54. In such a design, the plate receiver section 90 and the bushing receiver section 85 would limit or prevent unintentional movement of the spindle rod 54 in the axial direction of the spindle axis A (e.g. slipping of the spindle rod 54 through the spindle guide 68 in the case of accidental release/length adjustment, for instance, such as in the case of sudden table descent or drop). Accordingly, the difference in shape/size between these features may be utilized to prevent sudden table descent, and the cross-sectional shapes of the spindle rod 54 along varies points of the spindle rod 54 may be predetermined to be received by and/or rotate within and/or be fixed to rotate with various other components of the length-adjustable support 10.

The bushing assembly 56 as described herein provides a reduction or elimination in unintended adjustment of the length adjust support 10 (e.g. sudden table descent). Restriction of movement of the spindle plate 60 along the spindle axis A facilitates a fixed connection between movement of the spindle rod 54 and the bushing member 65 coupled to the motor housing 22.

Figure 7:
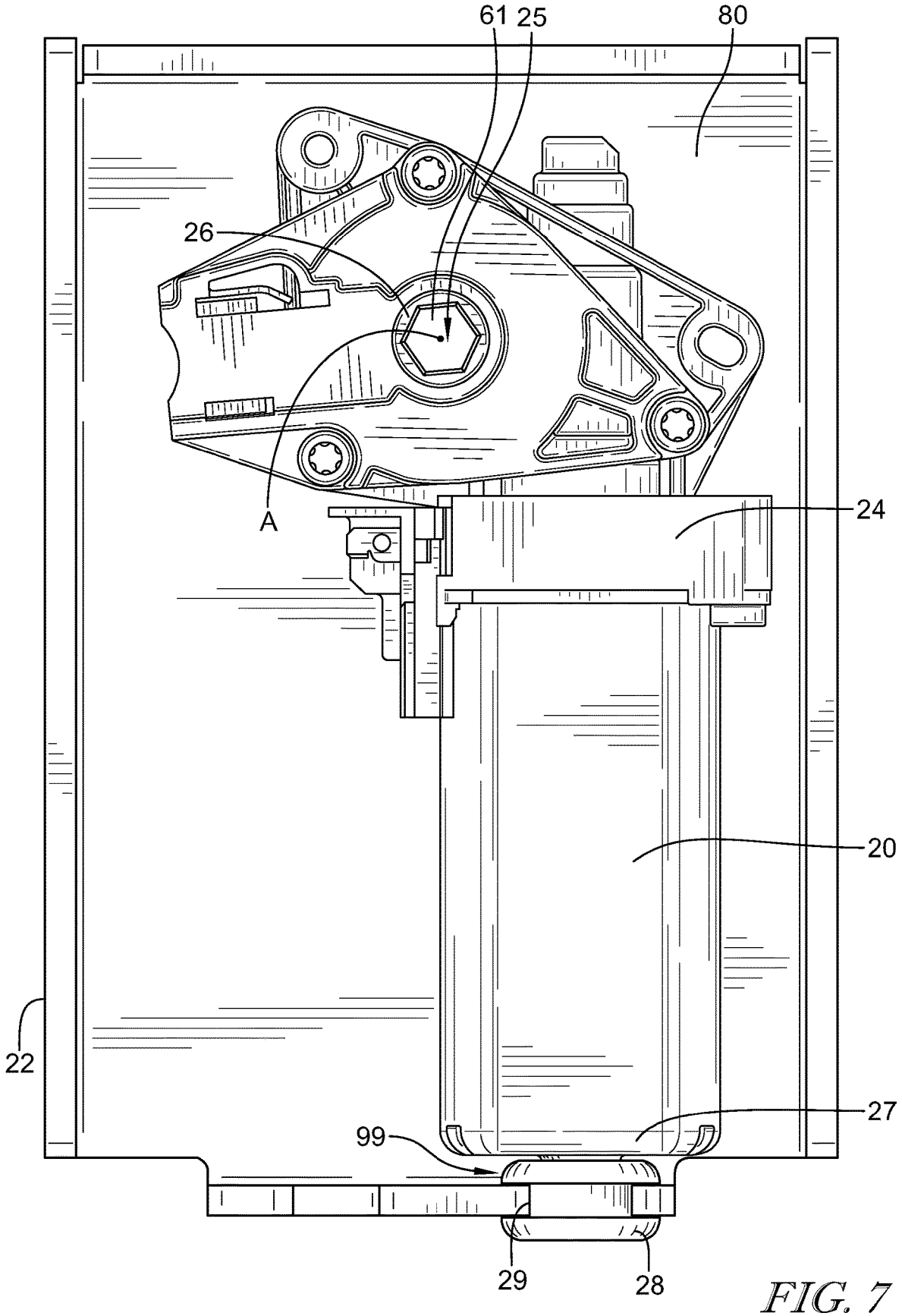
FIG. 7 is a top perspective view of the motor assembly of FIG. 1 within the motor housing, illustrating an exemplary embodiment of the fastener that secures the motor assembly may be a grommet.

The motor assembly 20 is received within the motor housing 22 and comprises at least a motor 24, a spindle driver 26 and a motor attachment arm 28, as illustrated in FIGS. 6-7. The motor 24 may be of any suitable design and configured to drive the spindle driver 26 to rotate upon operation of the motor 24. In illustrative embodiments, the motor 24 may be an electric motor powered via one or more electrical or power cords. The spindle driver 26 is configured to engage with the motor-engaging section 87 of the spindle rod 54 in order to rotate the spindle rod 54. In illustrative embodiments, the motor-engaging section 87 of the spindle rod 54 is hexagonal in shape, and the spindle driver 26 includes a hexagonal-shaped aperture 25 that is sized to receive the motor-engaging section 87 of the spindle rod 54. Accordingly, the spindle driver 26 may be positioned to be axially aligned with the motor-engaging section 87, and may further be positioned along the spindle axis A.

The motor 24 is configured to be substantially suspended within the motor housing 22. In order to avoid unnecessary downward force upon the spindle rod 54 from the motor 24, the motor may be coupled to a side flange 94 of the housing via the motor attachment arm 28. As illustrated in FIG. 6, the motor attachment arm 28 may be positioned to extend from the motor 24. In illustrative embodiments, the motor attachment arm 28 is configured to provide means to fix the motor within the motor housing to prevent the motor assembly 20 from rotating as it applies rotation force (torque) to the spindle rod 54. Connection of the motor attachment arm 28 to the side flange 94 permits the motor assembly 20 to substantially float within the motor housing 22 but still remain stationary within the housing as the motor 24 operates to apply rotational force upon the spindle rod 54 via the spindle driver 26. In various embodiments, the motor attachment arm 28 is a cylindrical shaped post or other feature that is incorporated into a housing 27 of the motor assembly 20. In various embodiments, the motor attachment arm 28 may extend substantially perpendicular to the spindle axis A, although other extension arrangements are envisioned herein.

In illustrative embodiments, a fastener 98 is configured to facilitate securement of the motor assembly 20 to the side flange 94 via the motor attachment arm 28. Specifically, the fastener 98 is configured to be received within a groove 96 formed in the side flange 94, although other methods of attaching the fastener 98 to the side flange 94 are envisioned herein. Illustratively, the groove 96 may be formed to be a complimentary shape to the fastener 98 or with a diameter that is sized to be the same or smaller than a diameter of the fastener 98. The fastener 98 may illustratively be configured to frictionally fit within the groove 96 so as to prevent unintentional removal of the fastener 98 from the side flange 94.

A variety of types of fasteners may be considered for the fastener 98. As illustrated in FIGS. 1-2 and 6, the fastener 98 may be in the form of a grommet 99 that can be coupled to the motor attachment arm 28 and to the side flange 94 to secure the two components together. The motor attachment arm 98 may be received within a central aperture 95 of the grommet 99 and the grommet 99 may be received within the groove 96 to retain the motor attachment arm 98 therewithin. A perimeter 97 of the grommet 99 may extend past the groove 96 and be positioned against or adjacent to the side flange 94. The grommet 99 may be formed of a plastic, metal or other suitable material to secure the two components together. While a grommet 99 is illustrated herein, the fastener 98 may be formed of other suitable fastening mechanisms as understood by one of skill in the art. When the motor attachment arm 28 is retaining within by the fastener 98 that is secured to the side flange 94 of the motor housing 22, the motor attachment arm 28 is prevented from exiting the fastener 98, and therefore the motor assembly 20 is prevented from movement (e.g. rotational movement) within the motor housing 22. The fastener 98 accordingly fixes the motor attachment arm 28 to the motor housing 22 and prevents rotations of the floating motor assembly 20 as it operates to apply torque to the spindle rod 54 without addition of other fasteners between the motor assembly 20 and the motor housing 22.

Figure 8:
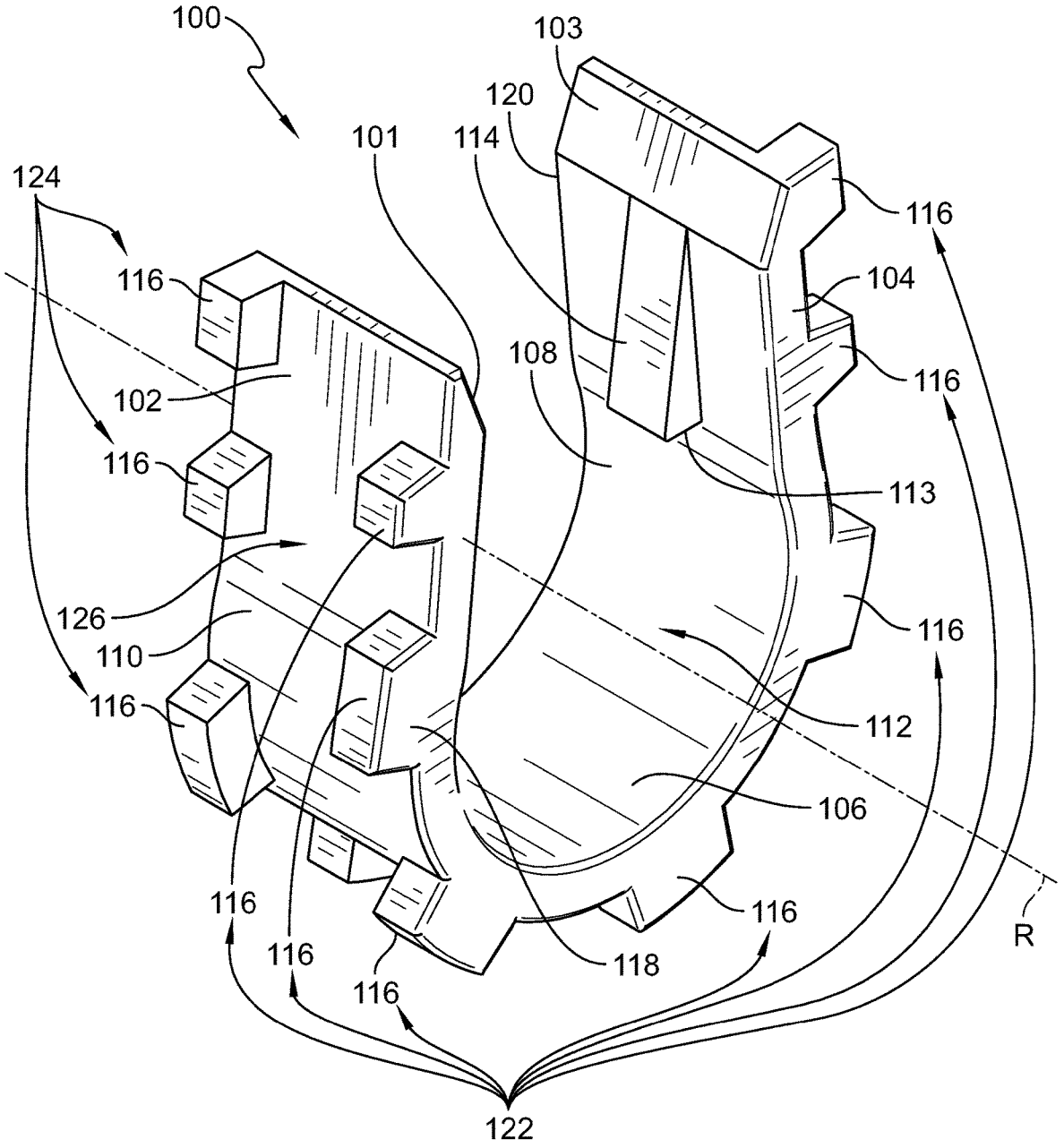
FIG. 8 is an example of an alternative embodiment of a fastener that secures the motor assembly of FIG. 1 to the motor housing, the fastener comprising a U-shaped motor clip that is configured to be engageable with the motor housing.
Figures 8A, 8B, 8C:
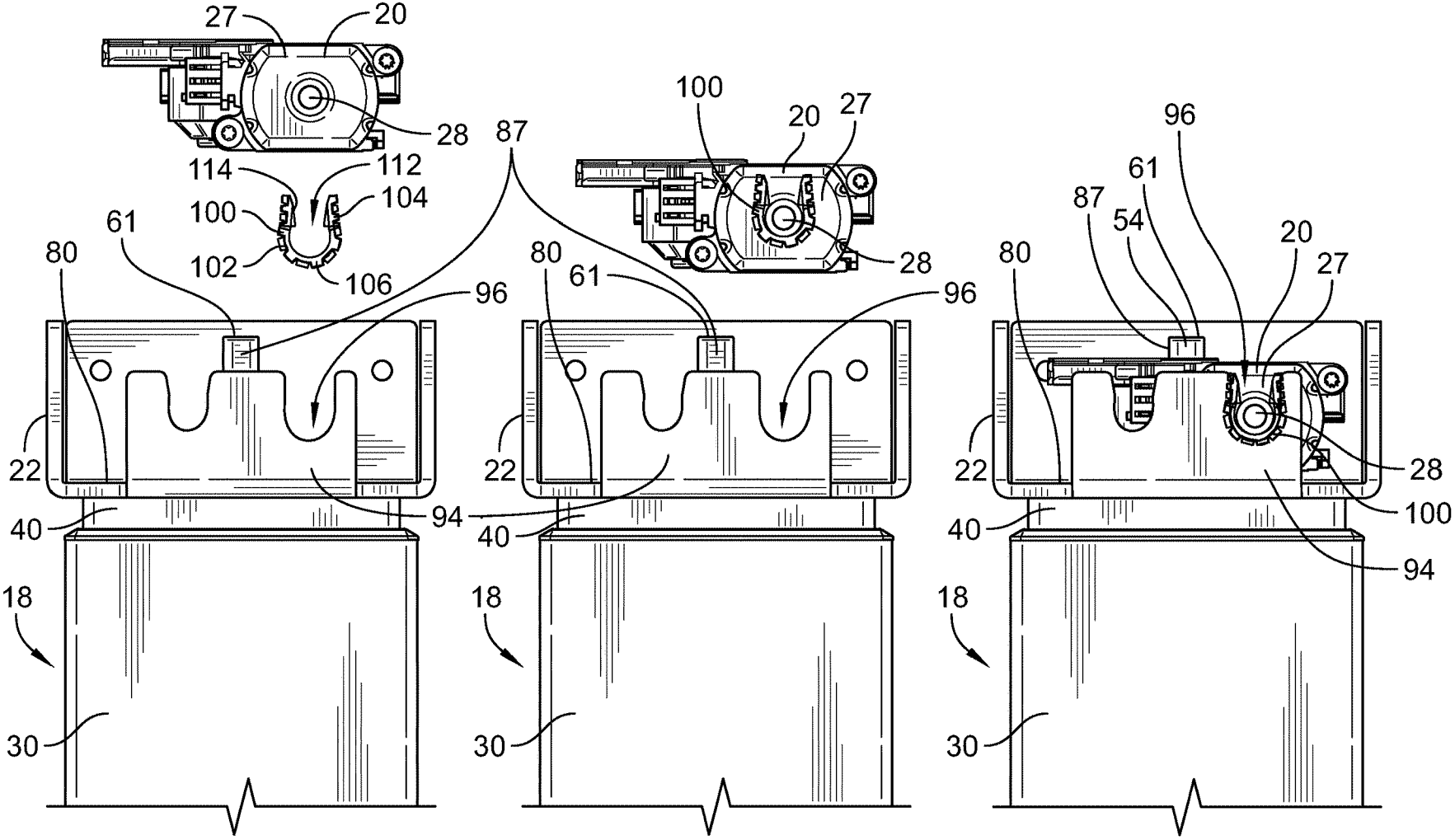
FIGS. 8A-8C are side perspective views of the top portion of the length-adjustment column showing assembly of the fastener of FIG. 8 with the motor assembly followed by assembly of the motor assembly and fastener with the motor housing to secure the motor assembly to the motor housing and the spindle assembly.

FIGS. 8-8C illustrate another exemplary embodiment of a fastener 98 in the form of a motor clip 100. Specifically, the motor clip 100 may be formed in a tear-drop or U-shaped configuration, as illustrated in FIG. 8. FIGS. 8A-8C illustrate how the motor clip 100 may connect to the motor attachment arm 28 to secure the motor assembly 20 to the motor housing 22. As illustrated, the motor clip 100 includes a first wing 102, a second wing 104, and a bridge 106 connecting the first wing 102 and the second wing 104. The motor clip 100 includes an interior surface 108 and an exterior surface 110, with the interior surface 108 forming a boundary to an arm-receiving notch or aperture 112 that extends through the motor clip 100 and is configured to receive a portion of the motor attachment arm 28. Accordingly, the motor clip 100 may be formed, as illustrated in FIG. 8, around an arm axis R that extends through the arm-receiving notch 112 and generally aligns with the motor attachment arm 28. The motor clip 100 may be formed of a semi-flexible or flexible plastic or other suitable material for the function identified herein. A portion of the exterior surface 110 may engage with the groove 96 of the slide flange 94 of the motor housing 22.

The exemplary motor clip 100 may further include one or more arm retainers 114 that are coupled to the interior surface 108 and extend into the arm-receiving notch 112. In various embodiments, the arm retainers 114 are positioned on the first and second wings 102 and 104 of the motor clip 100 and extend toward the arm-receiving notch 112 and the arm axis R. The arm retainers 114 include a stop surface 113 that is configured to engage with an exterior surface 29 of the motor attachment arm 28 in order to retain the motor attachment arm 28 within the arm-receiving notch 112. When the motor attachment arm 28 is retaining within the arm-receiving notch 112 and the motor clip 100 is secured to the side flange 94 of the motor housing 22, the motor attachment arm 28 is prevented from exiting the motor clip 100, and therefore the motor assembly 20 is prevented from movement (e.g. rotational movement) within the motor housing 22. As may be understood, the first and second wings 102 and 104 of the motor clip 100 may be configured to be resilient or have some flexibility to permit insertion of the motor attachment arm 28 into the arm-receiving notch 112. The first and second wings 102 and 104 may further include flanged receiving ends 101 and 103, respectively, that facilitate insertion of the motor attachment arm 28 and assist with guiding the motor attachment arm 28 into the arm-receiving notch 112.

In illustrative embodiments, the exterior surface 110 of the motor clip 100 may be formed with one or more teeth or prongs 116 that extend radially outward from the exterior surface 110 away from the arm axis R. The teeth 116 are configured to assist with retaining the motor clip 100 within the groove 96 and may engage with a portion of the side flange 94 to block lateral movement of the motor clip 100 along the arm axis R from its position within the groove 96. In various embodiments, and as illustrated in FIG. 8, the teeth 116 may be configured to extend along the first wing 102, second wing 104, and bridge 106 portions of the motor clip 100, although the teeth may extend from only one or two of such sections of the motor clip 100.

In another illustrative embodiment, the teeth 116 may be positioned along the exterior surface 110 adjacent to a front side 118 and a back side 120 of the motor clip 100 in order to block lateral movement of the motor clip 100 within the groove 96. Specifically, a first set 122 of teeth 116 may be positioned along the front side 118 and a second set 124 of teeth 116 may be positioned along the back side 120 such that a flange-receiving gap 126 is formed between the first and second sets 122 and 124. The flange-receiving gap 126 may be sized and configured to receive a portion of a wall of the side flange 94 of the motor housing 22 such that the sets 122 and 124 of teeth 116 will abut against the wall of the side flange 94 to prevent movement of the motor clip 100. The teeth 116 may be made of flexible material to facilitate insertion and removal of the side flange 94 from the flange-receiving gap 126. Further, the sets 122 and 124 of teeth 116 may be formed to have an off-set pattern of teeth 116, as illustrated in FIG. 8, to facilitate insertion and removal as well. The teeth 116 may be similarly sized and shaped, or of different shapes and sizes, in each set 122 and 124.

FIGS. 8A-8C illustrate an exemplary assembly of the motor assembly 20 to the motor housing 22 with the motor clip 100. As illustrated in FIG. 8A, the motor assembly 20 is positioned above the motor housing 22 such that the motor attachment arm 28 is positioned above the groove 96 in the side flange 94 of the housing 22. The motor clip 100 is first coupled to the motor attachment arm 28 before attachment to the housing 22, as illustrated in FIG. 8B. Then the coupled motor assembly 20 and motor clip 100 are both attached to the motor housing by inserting the motor clip 100 into the groove 96, as illustrated in FIG. 8C. As the assembled motor clip 100 and motor assembly 20 are forced or pressed into the groove 96 of the side flange 94, the first and second wings 102 and 104 of the motor clip 100 expand slightly and the sets 122 and 124 of the teeth 116 are positioned on either side of the wall of the side flange 94, fixing the motor assembly 20 in place. The motor clip 100 accordingly fixes the motor attachment arm 28 to the motor housing 22 and prevents rotations of the floating motor assembly 20 as it operates to apply torque to the spindle rod 54 without addition of other fasteners between the motor assembly 20 and the motor housing 22.

The length-adjustment support 10 may be assembled in a variety of ways. Illustratively, and as suggested in FIGS. 2 and 6, The spindle assembly 50 may be assembled first by inserting the spindle rod 54 into the spindle tube 52 and attaching the bushing member 65 and spindle plate 60 to the spindle rod 54 as described herein. The motor housing 22 is also fixedly coupled to the interior tube 40. After assembly of the spindle assembly 50, the spindle assembly 50 may be inserted into the spindle aperture 74 of the motor housing 22 to extend within the interior tube 40. During this process, the bushing member 65 is inserted into the spindle aperture 74 and frictionally engages with the bottom side 80 of the motor housing 22 to retain the spindle rod 54 in a fixed positioned relative to the motor housing 22. The bushing member 65 may further be secured to the bottom side 80 of the motor housing 22 via one or more set screws and/or the support plate 15. The spindle tube 52 of the spindle assembly 50 may then be attached to the exterior tube 30 or ground plate 17 as described above. The motor assembly 20 may then be inserted into the motor housing 22 such that the spindle driver 26 of the motor assembly 20 aligns with the spindle rod 54 exposed within the motor housing 22, and the motor clip 100 is secured to the motor attachment arm 28 and inserted into the groove 96 of the side flange 94 of the motor housing 22 to retain the motor assembly 20 in a substantially suspended position within the motor housing 22.

Figure 10A:
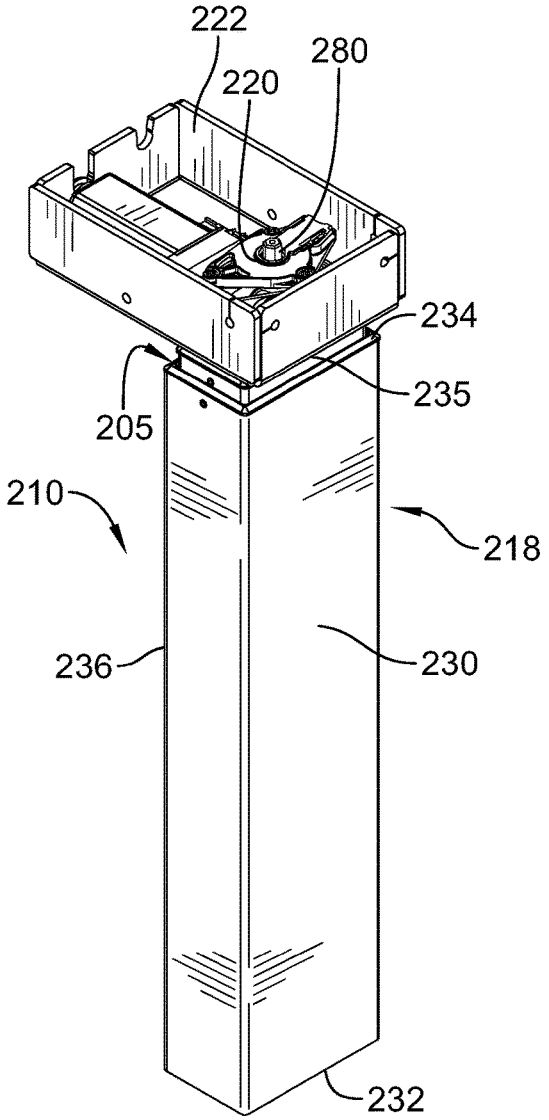
FIG. 10A is a side perspective view of a second exemplary embodiment of a length-adjustable support of the present disclosure in a lowered position, the length-adjustable support including a dual-stage telescopic column assembly, a motor housing and a motor contained within the motor housing and configured to adjust the length of the length-adjustable support.
Figure 10B:
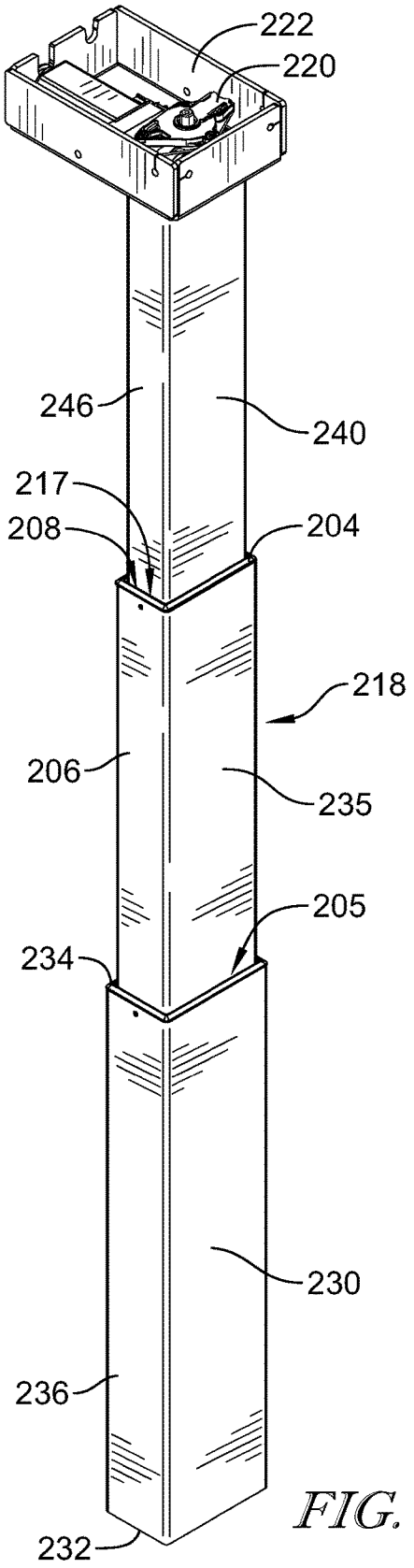
FIG. 10B is a side perspective view of the length-adjustable support of FIG. 10A after it has been moved to an extended position, illustrating the length-adjustable support includes first, second, and third leg components.

A second illustrative embodiment of a length-adjustable support 210 will now be described. As illustrated in FIGS. 10A-10B, the support 210 includes a dual-stage telescopic column assembly 218, a motor assembly 220, and a motor housing 222. Similar to as discussed above, the motor assembly 220 is configured to cause the dual-stage telescopic column assembly 218 to convert from a collapsed position to an extended position to adjust the length of the support 210 in order to, for example, adjust the height of the work surface. The motor assembly 220 and motor housing 222 are substantially similar to the first embodiment as described above. In particular, the motor assembly 220 is configured to drive multiple portions of the column assembly 218 to telescope with respect to each other to change the length of the column assembly 218. The motor housing 222 is configured to house a portion of the motor assembly 220 and be coupled to a bottom surface of the work surface. In various embodiments, the column assembly 218 is configured to extend between a ground plate and the motor housing 222 and be coupled thereto.

Figure 11:
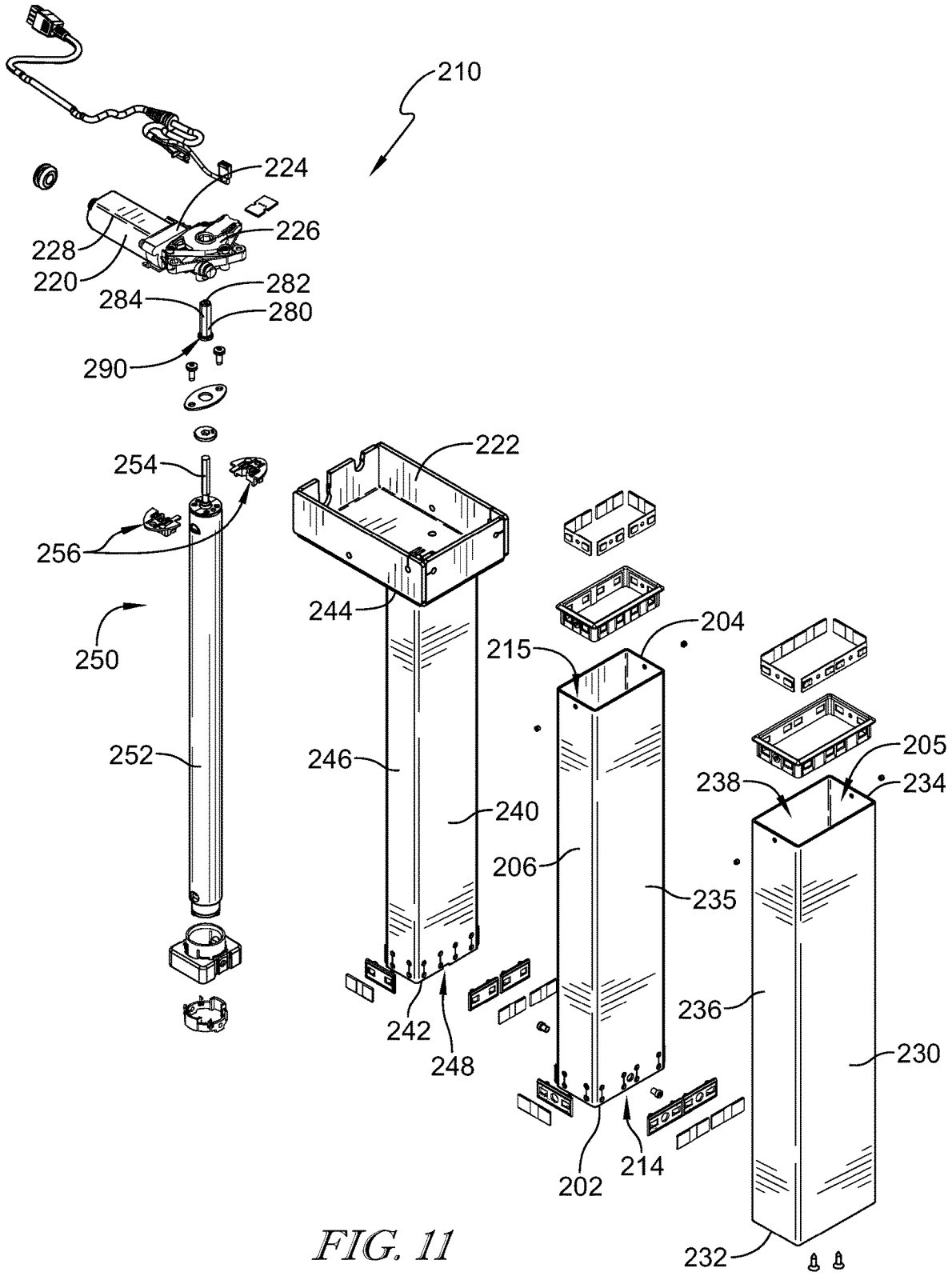
FIG. 11 is an exploded view of the length-adjustable support of FIG. 10A, showing the motor is configured to be coupled to a top portion of the telescopic column assembly and a dual-stage spindle assembly of the telescopic column assembly is engaged by the motor to operate adjustment of the length-adjustable support.

An illustrative embodiment of the column assembly 218 will now be described. As illustrated in FIGS. 10A-11, the column assembly 218 includes a first exterior tube 230, a second middle tube 235 configured to telescopically extend into and out of the exterior tube 230, and a third interior tube 240 configured to telescopically extend into and out of the middle tube 235. The column assembly 218 further includes a spindle assembly 250 configured to extend through a portion of the interior tube 240. Portions of the spindle assembly 250 are coupled to each of the exterior tube 230, middle tube 235, and interior tube 240 and configured to move therewith, as illustrated and described herein. The spindle assembly 250 is configured to be driven by the motor assembly 220 in order to cause both the middle tube 235 and the interior tube 240 to telescope out of the exterior tube 230 in order to adjust the length of the column assembly 218. Alternative configurations are envisioned herein.

The exterior tube 230 includes a first end 232, a second end 234, and a tube housing 236 that extends between the first and second ends 232 and 234 and defines a central passage 238 of the exterior tube 230. The central passage 238 is configured to receive the middle tube 235 (and the interior tube 240) when the column assembly 218 is in the collapsed state. The first end 232 of the exterior tube 230 is illustratively coupled to a ground plate 217, and the second end 234 of the exterior tube 230 is formed with an opening 205 through which the middle tube 235 telescopes through as it travels from the central passage 238 in order to extend the length of the column assembly 218. The middle tube 235 includes a first end 202, a second end 204, and a tube housing 206 that extends between the first and second ends 202 and 204 and defines a central passage 208 configured to receive the interior tube 240 when the column assembly 219 is in a collapsed state. The first end 202 is illustratively formed with an opening 214 through which the interior tube 240 telescopes through which a portion of the spindle assembly 250 extends to engage with the exterior tube 230 in order to extend the length of the column assembly 218. The second end 204 is also formed with an opening 215 through which both the interior tube 240 extends and a portion of the spindle assembly 250 attached to the interior tube 240 extends.

Figure 13A:
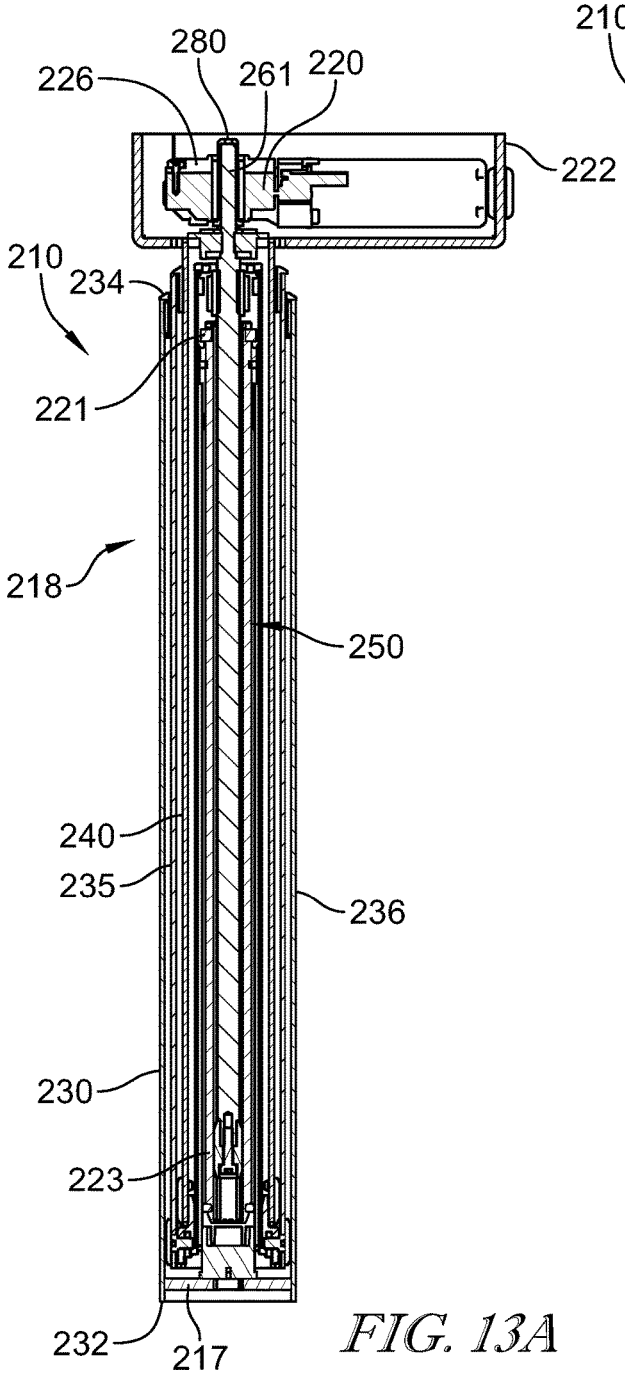
FIG. 13A is a cross-sectional side illustration of the length-adjustable support of FIG. 10A.
Figure 13B:
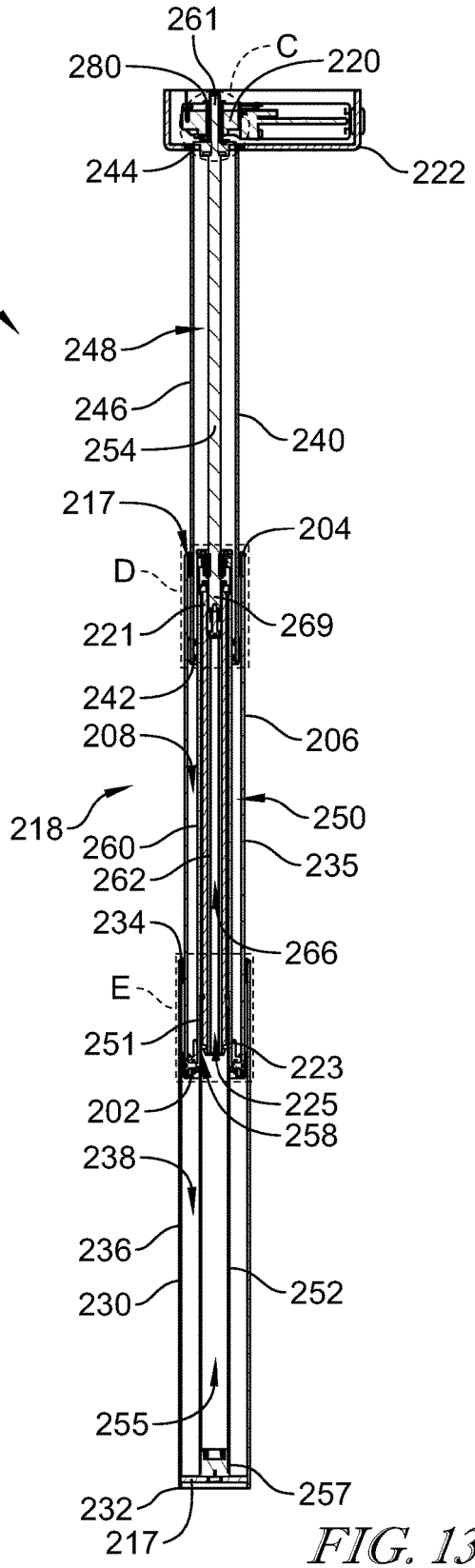
FIG. 13B is a cross-sectional side illustration of the length-adjustable support of FIG. 10B, illustrating the spindle assembly includes the spindle rod associated with the first leg portion of the length-adjustable support, a rod-receiving spindle tube associated with the second leg portion of the length-adjustable support, and an exterior spindle tube associated with the third leg portion of the length-adjustable support.
Figure 13C:
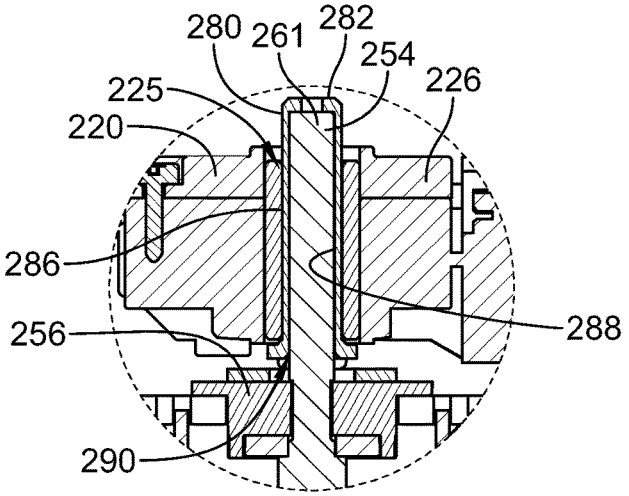
FIGS. 13C-13E are enlarged views of the cross-sectional view of FIG. 13B taken at points C, D, and E, respectively, of FIG. 13B.

The interior tube 240 includes a first end 242, a second end 244, and a tube housing 246 that extends between the first and second ends 242 and 244. The tube housing 246 is configured to be received within the opening 215 of the interior tube 240 when the interior tube 240 is telescoped within the middle tube 235. The tube housing 246 defines a central passage 248 of the interior tube 240 that extends from the first end 242 to the second end 244. The central passage 248 is configured to receive the spindle assembly 250 such that the tube housing 246 surrounds the spindle assembly 250. The first end 242 of the interior tube 240 is configured to be near the first end 202 of the middle tube 235 and the first end 232 of the exterior tube 230 when the column assembly 218 is in the collapsed state, as illustrated in FIG. 13A. Similarly, the second end 244 of the interior tube 240 is configured to be near the second end 204 of the middle tube 235 and the second end 234 of the exterior tube 230 when the column assembly 218 is in the collapsed state as illustrated in FIG. 13B. The second end 244 of the interior tube 240 is illustratively coupled to the motor housing 222, or it may be formed homogeneously with the motor housing 222.

Figure 14:
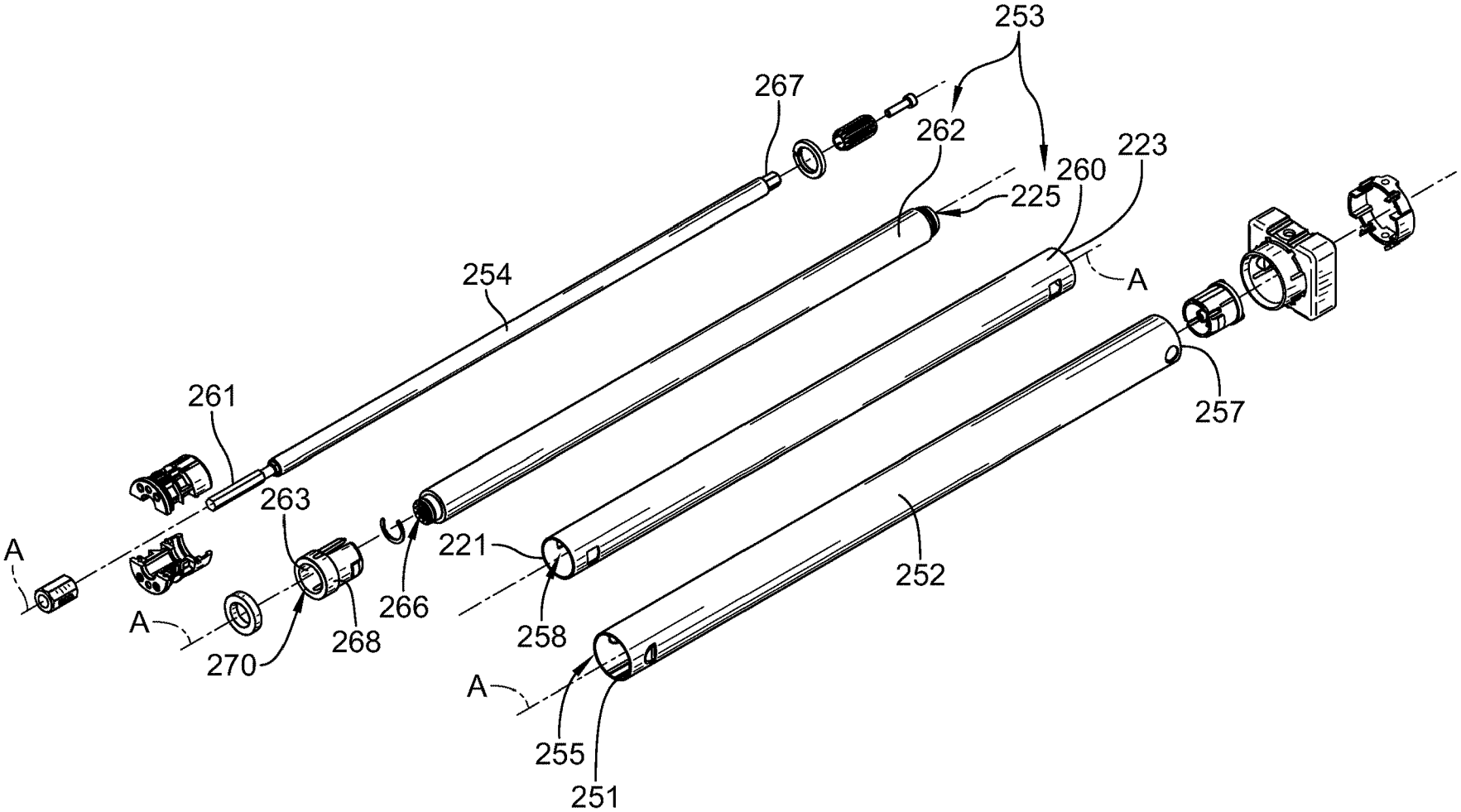
FIG. 14 is an exploded view of the dual-stage spindle assembly of the length-adjustable support of FIG. 11, illustrating the spindle assembly includes three spindle tubes of different diameters configured to be moved into and out of the respective larger diameter tubes via rotation of a spindle rod configured to extend within the smallest spindle tube.

The spindle assembly 250 includes an external spindle tube 252, an interior spindle tube assembly 253, a spindle rod 254, and a bushing assembly 256, as illustrated in FIGS. 11 and 14. The interior spindle tube assembly 253 includes a receiving tube 260 that is fixedly secured to around a circumference of a threaded spindle tube 262 adjacent a top end 221 of the spindle tube assembly 253, with the receiving tube 260 spaced away from the threaded spindle tube 262 to define a external tube receiving channel 258 therebetween.

The exterior spindle tube 252 is formed to include a central passage 255 through which the threaded spindle tube 262 of the spindle tube assembly 253 extends into and out of when telescoping occurs. At the same time, the exterior spindle tube 252 is configured to extend into and out of the receiving channel 258 between the threaded spindle tube 262 and receiving tube 260 when telescoping occurs. The threaded spindle tube 262 includes a central passageway 266 through which the spindle rod 254 extends into and out of when the telescoping occurs. The exterior spindle tube 252, interior spindle tube assembly 253, and spindle rod 254 are configured to extend along and substantially surround a spindle axis A while telescoping. As described above regarding bushing assembly 56, the bushing assembly 256 is configured to couple the spindle assembly 250, and specifically the spindle rod 254, to the motor housing 222.

As illustrated in FIGS. 13A-13E, the exterior spindle tube 252 is coupled to the exterior tube 230 and the exterior spindle tube 252 is configured to move therewith as telescoping occurs. Similarly, the interior spindle tube assembly 253 is coupled to the middle tube 235 and the interior spindle tube assembly 253 is configured to move therewith as telescoping occurs. Finally, the spindle rod 254 is coupled to the interior tube 240 and the spindle rod 254 is configured to move therewith while telescoping occurs. The interior spindle tube assembly 253 is configured to be received within the central passage 238 of the exterior spindle tube 252, and the spindle rod 254 is configured to be received within the interior spindle tube assembly 253, when the spindle assembly 250 is retracted to a retracted position from an extended position.

As noted, the exterior spindle tube 252 is configured to be attached to the ground plate 217 or first end 232 of the exterior tube 230. The exterior spindle tube 252 includes a first end 251 and a second end 257, with the central passage 255 extending therebetween. The second end 257 may generally correspond in vertical location with the first end 232 of the exterior tube 230, and the first end 251 may generally correspond in vertical location with the second end 234 of the exterior tube 240. The exterior spindle tube 252 is illustratively fixed relative to the exterior tube 240, as illustrated in FIG. 13B. Similarly, the interior spindle tube assembly 253 includes the first end 221 and a second end 223, with a central passage 225 extending therebetween. The second end 223 may generally correspond in vertical location with the first end 202 of the middle tube 235, and the first end 221 may generally correspond in vertical location with the second end 204 of the middle tube 235. The interior spindle tube assembly 253 is illustratively fixed relative to the middle tube 235, as illustrated. The spindle rod 254 is configured to be attached or fixed relative to the motor housing 220, which in turn is attached or fixed relative to the interior tube 240.

As noted, the spindle rod 254 is configured to be received within the central passage 66 of the threaded spindle tube 262 of the interior spindle tube assembly 253 and extends substantially along spindle axis A. The spindle rod 254 is configured to rotate during operation of the spindle assembly 250 to change the length of the length-adjustable support 210, similar to as described above with regard to spindle rod 54. In particular, rotation of the spindle rod 254 is configured to telescope the spindle rod 254 into and out of the central passage 266 of the threaded spindle tube 266 of the interior spindle tube assembly 253. Further, the spindle rod 254 is also configured to cause rotation of the threaded spindle tube 262 of the interior spindle tube assembly 253 within the exterior spindle tube 252. Rotation of the spindle rod 254 causes the spindle tube 262 to telescope into and out of the central passage 255 of the exterior spindle tube 252. Accordingly, rotation of the spindle rod 254 causes both the spindle rod 254 to telescope into and out of the interior spindle tube assembly 253, as well as the threaded spindle tube 262 of the interior spindle tube assembly 253 to telescope into and out of the exterior spindle tube 252.

The spindle rod 254 includes a first end 261 and a second end 267. The first end 261 may generally correspond in location with the motor housing 222 that is adjacent the second end 244 of the interior tube 240. The second end 267 may generally correspond in location with the second end 223 of the interior spindle tube assembly 253 when the length-adjustment support 10 is in the collapsed position, but may be moved away from the second end 223 towards the first end 221 when the spindle assembly 250 is moved to an extended position.

In illustrative embodiments, a first spindle guide 268 may be illustratively coupled to the first end 221 of the interior spindle tube assembly 253. Similarly, a second spindle guide 269 may be illustratively coupled to the first end 257 of the exterior spindle tube 252. The spindle guide 268 is configured to receive and retain the spindle rod 254 while permitting the spindle rod 254 to move with respect to the interior spindle tube assembly 253 into and out of the spindle tube assembly 253. Similarly, the spindle guide 269 is configured to receive and retain the interior spindle tube assembly 253 while permitting the interior spindle tube assembly 253 to move with respect to the exterior spindle tube 252 into and out of the exterior spindle tube 252. The spindle guides 268 and 269 illustratively provide a guide means for the spindle rod 254 and interior spindle tube assembly 253 as they telescopes within the interior spindle tube assembly 253 and exterior spindle tube 252, respectively, by providing engagement between those components.

Figure 13D:
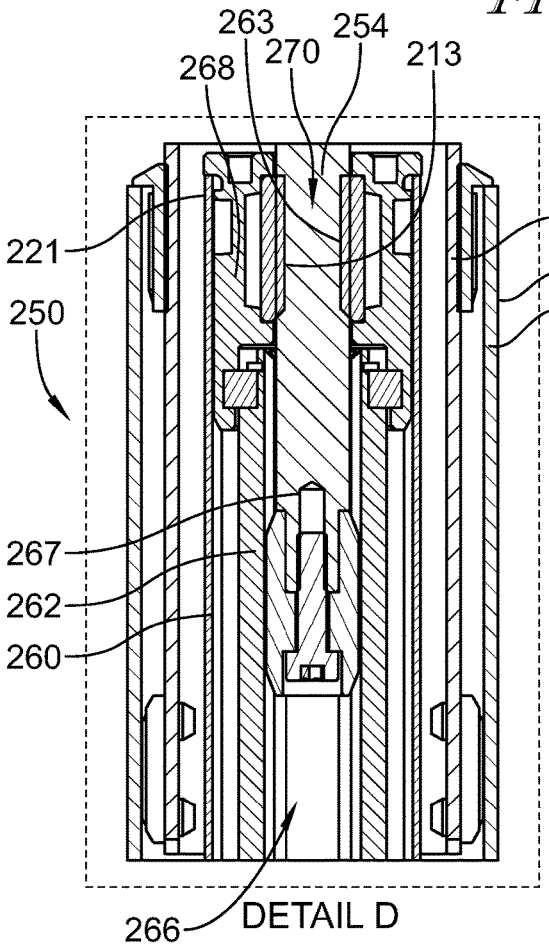

Illustratively, the spindle guide 268 includes a central passage 270 that is formed by an interior surface 263 of the spindle guide 268 to permit the spindle rod 254 to pass through, as illustrated in FIG. 13D. The interior surface 263 of the spindle guide 268 is configured to engage with a mating section 213 of the spindle rod 254 to permit the spindle rod 254 to rotate within the spindle guide 268 as the spindle guide 268 remains substantially fixed and coupled to the interior spindle tube assembly 253. In illustrative embodiments, the mating section 213 of the spindle rod 254 includes male threading and the interior surface 263 of the spindle guide 268 includes female threading that receives the male threading of the spindle rod 254. As the spindle rod 254 rotates, the male threading travels through the female threading, effectively lengthening or reducing the distance from the first end 261 of the spindle rod 254 to the second end 223 of the interior spindle tube assembly 253.

Figure 13E:
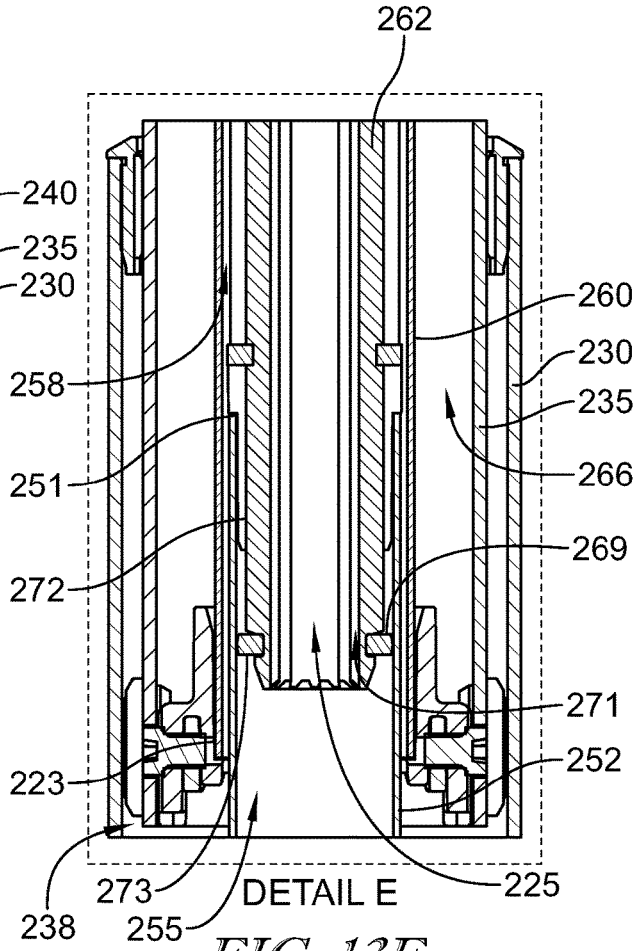

Similarly, the spindle guide 269 includes a central passage 271 that is formed by an interior surface 273 of the spindle guide 269 to permit the interior spindle tube assembly 253 to pass through, as can be understood and is illustrated in FIG. 13E. The interior surface 273 of the spindle guide 269 is configured to engage with a mating section 272 of the threaded spindle tube 262 of the interior spindle tube assembly 253 to permit the spindle tube 262 to rotate within the spindle guide 269 as the spindle guide 269 remains substantially fixed and coupled to the exterior spindle tube 252. In illustrative embodiments, the mating section 272 of the threaded spindle tube 262 includes male threading and the interior surface 273 of the spindle guide 269 includes female threading that receives the male threading of the threaded spindle tube 262. As the threaded spindle tube 262 rotates, the male threading travels through the female threading, effectively lengthening or reducing the distance from the first end 221 of the interior spindle tube assembly 253 to the second end 257 of the exterior spindle tube 252. Length adjustment of the spindle assembly 50 may accordingly be achieved.

In various embodiments, the pitch of the threading on the mating section 272 of the interior spindle tube 262 and spindle guide 269 may be formed to be the same as or different from, the threading on the mating section 213 of the spindle rod 254 and the spindle guide 268 so that extension and retraction of the corresponding components of the spindle assembly 250 may be achieved at the same or different rates, as would be understood by someone of skill in the art. In an illustrative embodiment, the rate of extension of between the mating section 272 of the interior spindle tube 262 and spindle guide 269 may be twice as fast as the rate of extension between the mating section 213 of the spindle rod 254 and the spindle guide 268.

In an exemplary embodiment, the spindle guide 268 is coupled to and configured to engage with an interior surface of the interior spindle tube assembly 253. Accordingly, the spindle rod 254 may be inserted through the central passage 270 of the spindle guide 268 and the central passage 255 of the interior spindle tube assembly 253. Other means of securing the spindle guide 268 to the spindle tube assembly 253 are envisioned herein. Alternatively, the spindle guide 268 may be integrally formed with the first end 221 of the interior spindle tube assembly 253. In assembly, the second end 267 of the spindle rod 254 may be threadingly received within the central passage 269 of the spindle guide 268 and then pass into the central passage 255 of the interior spindle tube assembly 253. The spindle rod 254 may be rotated in order to be inserted into the central passage 255 in order to cause the male and female threading to engage with each other. The spindle rod 254 may be rotated until a predetermined length of male threading is traversed. This may occur when the length-adjustment support 210 is in the collapsed state, for example. As can be understood, a similar process may be implemented for rotation of the threaded spindle tube 262 of the spindle tube assembly 253 within the spindle guide 269 that is configured to be coupled to and engaged with an interior surface of the exterior spindle tube 252.

The spindle guide 268 may be configured to cause rotation of the threaded spindle tube 262 of the interior spindle tube assembly 253 when the spindle rod 254 is rotated, thereby permitting rotation of the threaded spindle tube 262 by rotation of the spindle rod 254 via the motor assembly 220. In various embodiments, such rotation of the threaded spindle tube 262 may occur at the same time as rotation of the spindle rod 254 within the spindle guide 268, or it may be offset or delayed to occur after a pre-determined length of the male threading is traversed, as discussed above. Accordingly, activation of the motor assembly 220 is configured to cause both the spindle rod 254 to rotate to extend the length between the ends of the interior tube 240 and middle tube 235, as well as to cause the threaded spindle tube 262 to rotate to extend the length between the ends of the middle tube 235 and exterior tube 240.

As noted above, the motor assembly 220 of the second embodiment is substantially similar to the motor assembly 20 described above regarding the first embodiment. However, the spindle assembly 250 of the dual-stage design of the second embodiment may have additional size constraints that require a smaller diameter spindle rod 254, with a correspondingly smaller diameter first end 261, to be utilized in the spindle assembly 250. In light of this, an adapter may be necessary for the first end 261 in order for it to properly engage with the hexagonal-shaped aperture 25 of the motor assembly.

Figure 12A:
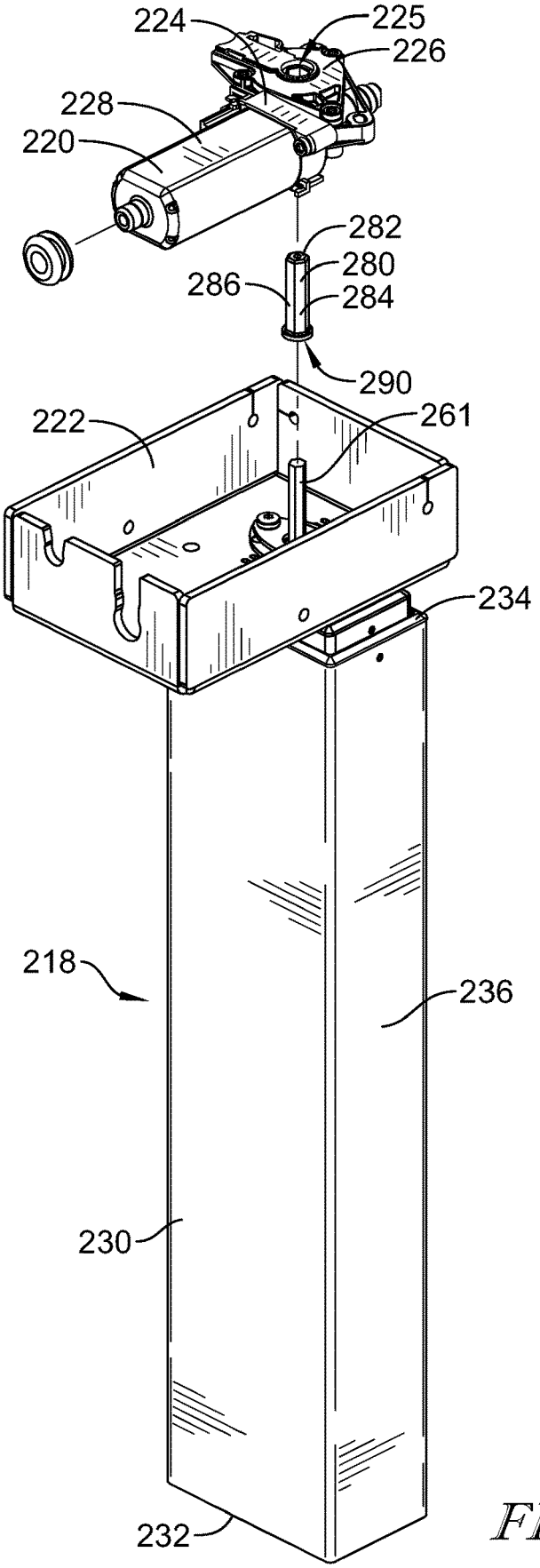
FIGS. 12A-12C are side perspective views of the length-adjustable column of FIG. 10A showing assembly of the motor with a spindle rod of the dual-stage spindle assembly via a rod adapter positioned on the spindle rod followed by assembly of the motor assembly with the motor housing.
Figure 12B:
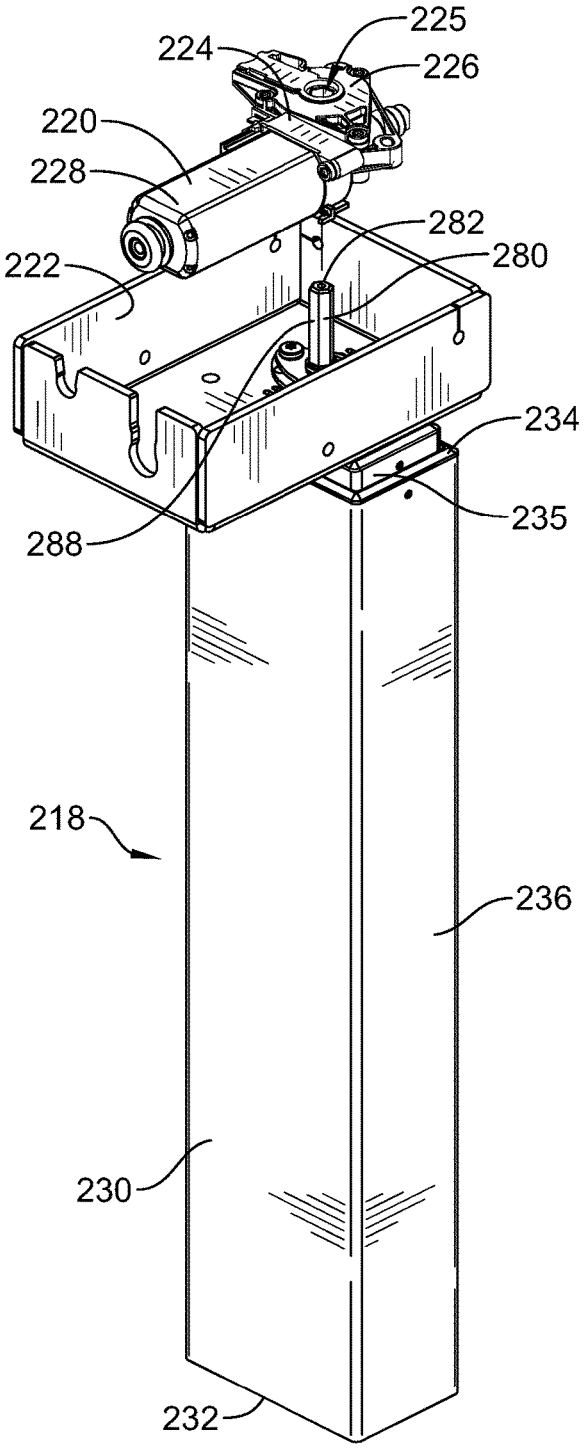
Figure 12C:
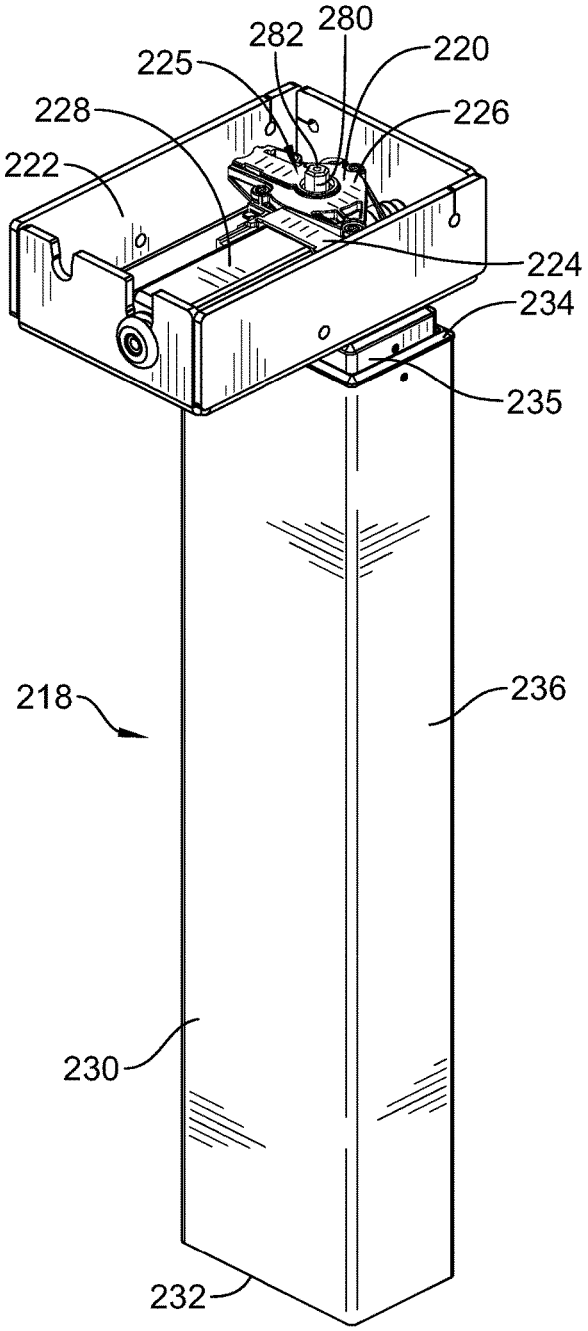

For instance, the motor assembly 220 is received within the motor housing 222 and, similar to as described above, comprises at least a motor 224, a spindle driver 226 and a motor attachment arm 228, as illustrated in FIGS. 11-12C. The motor 224 may be of any suitable design and configured to drive the spindle driver 226 to rotate upon operation of the motor 224. In illustrative embodiments, the motor 224 may be an electric motor powered via one or more electrical or power cords. The spindle driver 226 is configured to cause the first end 261 of the spindle rod 254 to rotate. An adapter 280, as illustrated in FIG. 12A, is configured to be received on the first end 261 of the spindle rod 254 and is sized to be compatible with an aperture 224 of the spindle driver 226. In illustrative embodiments, the adapter is a hex-shaped adapter 280, and the aperture 224 is a hexagonal-shaped aperture 224, although other shapes and sizes for the adapter 280 and aperture 224 are envisioned herein. As would be understood, the hex adapter 280 is hexagonal in shape, and the spindle driver 226 includes an opening to receive the hex adapter 280 into the hexagonal-shaped aperture 225 which has a corresponding hexagonal shape. Accordingly, the spindle driver 226 may be positioned to be axially aligned with the adapter 280 on the first end 261 of the spindle rod 254, and may further be positioned along the spindle axis A.

In an illustrative embodiment, the adapter 280 comprises a top wall 282 and a body 284 that extends down form the top wall 282. The body 284 may define an outer surface 286 and an inner surface 288 that are both hexagonally shaped. The inner surface 288 of the body 284 defines a rod-receiving space 290 that is configured to receive and engage with the first end 261 of the spindle rod 254. The inner surface 288 and first end 261 are sized and shaped to correspond with each other such that the adapter 280 can slide onto the first end 261 of the spindle rode 254, with the top wall 282 of the adapter 280 abutting against the top of the first end 261 to prevent further movement of the adapter 280 with respect to the spindle rod 254.

FIGS. 12A-12C illustrate one example of how the adapter 280 can be assembled with the motor assembly 220 and the spindle rod 254 of the spindle assembly 250 of the dual stage design. As illustrated in FIG. 12A, the dual-stage column assembly 218 (including the spindle assembly 250) is attached to the motor housing 222 such that the first end 261 of the spindle rod 254 extends into the motor housing 222. The adapter 280 acts a female component that is coupled to the first end 261 of the spindle rod 254 by sliding onto the first end 261, as illustrated in FIG. 12B. The adapter 280 and first end 261 are sized and shaped to correspond to each other so that rotation of the adapter 280 causes rotation of the spindle rod 254. The motor assembly 220 is then coupled to the motor housing 222 and the adapter 280 is received within the aperture 225 of the motor assembly 220 to permit the spindle driver 226 to rotate the adapter 280 and thereby the spindle rod 254 to cause telescoping of the spindle assembly 250 as described and shown above.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A bushing assembly engageable with a spindle rod that extends along a spindle axis, the bushing assembly comprising:

a first bushing component comprising a first top surface, a first side surface that is formed to include a first spindle recess open to the first top surface and configured to be positioned radially around the spindle axis, a first latch element positioned along the first top surface and extending away from the first side surface adjacent to one side of the first spindle recess, and a first latch aperture positioned along the first top surface adjacent to an opposite side of the first spindle recess; and a second bushing component comprising a second top surface, a second side surface that is formed to include a second spindle recess open to the second top surface and configured to be positioned radially around the spindle axis, a second latch element positioned along the second top surface and extending away from the second side surface adjacent to one side of the second spindle recess, and a second latch aperture positioned along the second top surface adjacent to an opposite side of the second spindle recess;

wherein the first and second bushing components are configured to be coupled together such that the first and second spindle recesses are positioned adjacent to each other to form a spindle aperture that the spindle rod extends through;

and wherein the first latch aperture is configured to receive the second latch element, and the second latch aperture is configured to receive the first latch element, to secure the first and second bushing components together.

2. The bushing assembly of claim 1, wherein the first side surface engages the second side surface when the first and second bushing components are coupled together.

3. The bushing assembly of claim 1, wherein the bushing assembly further comprises a spindle plate defining a spindle aperture configured to receive the spindle rod, the spindle plate configured to engage with the first and second bushing components such that the spindle rod extends through the spindle aperture of the spindle plate and through the spindle aperture formed by the first and second spindle recesses of the respective first and second bushing components.

4. The bushing assembly of claim 3, wherein the first bushing component further includes a first bottom surface that is formed to include a first plate-receiving aperture, and the second bushing component further includes a second bottom surface formed to include a second plate-receiving aperture, and wherein the first and second plate-receiving apertures receive the spindle plate and are positioned radially around the spindle axis when the first and second bushing components are coupled together.

5. The bushing assembly of claim 4, wherein the spindle plate is configured to rotate with the spindle rod relative to the first and second bushing components, and the spindle plate rotates within the first and second plate-receiving apertures.

6. A spindle assembly, the spindle assembly comprising:

a spindle tube formed to include a central passage, the spindle tube including a first end and a second end;

a spindle rod that is configured to telescope into and out of the central passage at the first end of the spindle tube along a spindle axis; and a bushing assembly engageable with the spindle rod, the bushing assembly comprising:

a first bushing component comprising a first top surface, a first side surface that is formed to include a first spindle recess open to the first top surface and configured to extend radially about the spindle axis, and at least one of a latch element or a latch aperture positioned adjacent the first top surface;

a second bushing component comprising a second top surface, a second side surface that is formed to include a second spindle recess open to the second top surface and configured to extend radially about the spindle axis, and the other of the latch element or latch aperture positioned adjacent the second top surface;

wherein the first and second bushing components are configured to be coupled together such that the first and second spindle recesses are positioned adjacent to each other to form a spindle aperture that the spindle rod extends through;

and wherein the latch aperture is configured to receive the latch element to secure the first and second bushing components together around the spindle rod.

7. The spindle assembly of claim 6, wherein the spindle assembly further includes a spindle guide within the central passage of the spindle tube that engages with the spindle rod to facilitate telescoping the spindle rod into and out of the spindle tube.

8. The spindle assembly of claim 7, wherein the spindle rod comprises an outside surface having male threading, and the spindle guide comprises an inside surface having female threading configured to mate with the male threading.

9. The spindle assembly of claim 8, wherein the bushing assembly is configured to engage with the spindle rod along a bushing receiver section of the spindle rod that does not include threading.

10. The spindle assembly of claim 6, wherein the bushing assembly further comprises a spindle plate configured to be engaged by the spindle rod to rotate therewith.

11. The spindle assembly of claim 10, wherein the spindle rod rotates to telescope into and out of the spindle tube, and wherein the spindle plate is configured to rotate within a plate aperture formed in the first and second bushing components when the spindle rod rotates.

12. The spindle assembly of claim 10, wherein the spindle plate is formed to include a spindle aperture that receives the spindle rod to rotate therewith.

13. The spindle assembly of claim 12, wherein the spindle rod includes a plate-receiving section, a bushing-receiving section, and a threaded section, and wherein the plate-receiving section of the spindle rod is configured to extend within the spindle aperture of the spindle plate and is positioned between the bushing-receiving section and the threaded section.

14. The spindle assembly of claim 13, wherein the plate-receiving section of the spindle rod and the spindle aperture of the spindle plate are hexagonal in shape.

15. The spindle assembly of claim 6, wherein the spindle rod includes a bushing receiver section and a threaded section, and wherein the bushing receiver section is positioned between a first end of the spindle rod and the threaded section, and wherein the first and second bushing components correspond to the bushing receiver section of the spindle rod when the first and second bushing components are coupled around the spindle rod.

16. The spindle assembly of claim 6, wherein the first and second bushing components are configured to be coupled together to form a bushing member around the spindle rod, and wherein the bushing member has an external perimeter that is larger than a perimeter of the spindle tube.

17. A motorized length-adjustable support comprising:

a motor assembly including a motor;

a motor housing configured to support the motor assembly; and a telescopic column assembly comprising an exterior tube, an interior tube that is configured to telescope into and out of the exterior tube and is coupled to the motor housing, and a spindle assembly, the spindle assembly comprising:

a spindle tube coupled to the exterior tube;

a spindle rod assembly configured to telescope into and out of the spindle tube along a spindle axis, the spindle rod assembly including a spindle rod configured to be rotated by the motor; and a bushing assembly that is engagable with the spindle rod near a first end of the spindle rod and connects the spindle rod to the motor housing, the bushing assembly comprising:

a first bushing component that is formed to include a first spindle recess that receives a portion of the spindle rod, the first spindle recess configured to be radially around the spindle axis, a second bushing component complimentary to the first bushing component that is formed to include a second spindle recess that receives a portion of the spindle rod, the second spindle recess configured to be radially around the spindle axis; and wherein a latch element is provided on either the first or second bushing components, or both, to connect the first and second bushing components together around the spindle rod.

18. The length-adjustable support of claim 17 further including an adapter configured to be received on the first end of the spindle rod, the adapter engageable by a portion of the motor to rotate the spindle rod.

19. The length-adjustable support of claim 17, wherein the spindle rod assembly further includes an interior spindle tube assembly that comprises an interior spindle tube and a receiving tube, the interior spindle tube including a lengthwise aperture through which the spindle rod telescopes into and out of during rotation of the spindle rod.

20. The length-adjustable support of claim 19, wherein the interior spindle tube is configured to rotate and to telescope into and out of the spindle tube of the spindle assembly to cause the spindle rod assembly to telescope into and out of the spindle tube of the spindle assembly.

* * * * *